US012383053B2

(12) United States Patent
Rubio et al.

(10) Patent No.: US 12,383,053 B2
(45) Date of Patent: Aug. 12, 2025

(54) DROPDOWN ROBOTIC FURNITURE ITEM

(71) Applicant: Ori Inc., Boston, MA (US)

(72) Inventors: Carlos Rubio, Austin, TX (US); Daniel E. Meyer, Marblehead, MA (US); Ivan Fernandez De Casadevante, Cambridge, MA (US); Hasier Larrea Tamayo, Brooklyn, NY (US); Robert T. Hsiung, Cambridge, MA (US)

(73) Assignee: Ori Inc., Boston, MA (US)

( * ) Notice: Subject to any disclaimer, the term of this patent is extended or adjusted under 35 U.S.C. 154(b) by 82 days.

(21) Appl. No.: 18/041,496

(22) PCT Filed: Oct. 8, 2021

(86) PCT No.: PCT/US2021/054246
§ 371 (c)(1),
(2) Date: Feb. 13, 2023

(87) PCT Pub. No.: WO2022/076869
PCT Pub. Date: Apr. 14, 2022

(65) Prior Publication Data

US 2023/0301426 A1 Sep. 28, 2023

Related U.S. Application Data

(60) Provisional application No. 63/089,571, filed on Oct. 9, 2020.

(51) Int. Cl.
*A47B 5/00* (2006.01)
*A47C 17/84* (2006.01)

(52) U.S. Cl.
CPC ..... *A47B 5/00* (2013.01); *A47C 17/84* (2013.01); *A47B 2005/003* (2013.01)

(58) Field of Classification Search
CPC ..... A47B 5/00; A47B 5/006; A47B 2005/003; A47C 17/84
See application file for complete search history.

(56) References Cited

U.S. PATENT DOCUMENTS 5,153,844 A * 10/1992 Beni ..... G01B 11/306 73/104
9,009,893 B2 * 4/2015 Kramer ..... A61G 7/052 5/613

(Continued)

FOREIGN PATENT DOCUMENTS

WO WO-2014/144368 A1 9/2014

OTHER PUBLICATIONS

International Search Report and Written Opinion for PCT/US2021/054246 dated Apr. 7, 2022, 6 pages.

*Primary Examiner* — Chi Q Nguyen
(74) *Attorney, Agent, or Firm* — Goodwin Procter LLP

(57) ABSTRACT

Improved methods and systems for operating moveable architectural elements (e.g., furniture) are described. The method includes performing a first part of a movement of the moveable architectural element along a portion of a length of actuation using a motor. The method includes performing a second part of the movement of the moveable architectural element with a desired movement profile and, based thereon, measuring an operation parameter. The method includes comparing the measured operation parameter to a profile of the operation parameter. The method includes incrementing a first counter if a first differential between the measured operation parameter and the profile of the operation parameter exceeds a differential threshold. The method includes adjusting the second part of the movement of the moveable architectural element if the first counter exceeds a counter threshold. Many other improvements and features are contemplated and described.

20 Claims, 16 Drawing Sheets

(56) References Cited

U.S. PATENT DOCUMENTS

| | | | | |
|---|---|---|---|---|
| 9,644,366 | B2 * | 5/2017 | Timur | G06Q 20/145 |
| 11,422,565 | B1 * | 8/2022 | Webster | G05D 1/0088 |
| 2005/0279035 | A1 * | 12/2005 | Donovan | F24F 5/0046 52/79.1 |
| 2008/0052782 | A1 * | 2/2008 | Hillis | G06F 21/32 726/26 |
| 2010/0132113 | A1 * | 6/2010 | Roepke | A47C 17/84 5/10.1 |
| 2013/0276373 | A1 * | 10/2013 | Haab | E05D 15/26 49/506 |
| 2014/0159410 | A1 * | 6/2014 | Rasmussen | B60P 3/39 296/24.33 |
| 2015/0329035 | A1 * | 11/2015 | Johnson | A47C 17/80 5/503.1 |
| 2017/0318978 | A1 * | 11/2017 | Flemister | A61G 11/008 |
| 2018/0027978 | A1 * | 2/2018 | Johnson | A47C 17/86 |
| 2020/0256109 | A1 | 8/2020 | Bean et al. | |
| 2022/0225217 | A1 * | 7/2022 | Silverman | H04W 48/20 |

* cited by examiner

100

1000

DROPDOWN ROBOTIC FURNITURE ITEM

CROSS REFERENCE TO RELATED APPLICATION

This application is the National Stage of International Application No. PCT/US2021/054246, filed Oct. 8, 2021, titled "Dropdown Robotic Furniture Item," which claims priority to and the benefit of U.S. Provisional Patent Application No. 63/089,571 filed on Oct. 9, 2020, titled "Dropdown Robotic Furniture Item," the contents of each of which are incorporated by reference herein in their entirety.

FIELD OF THE INVENTION

The invention relates generally to apparatuses, systems and methods for safely and effectively operating moveable robotic elements, and, more specifically, to devices and techniques for moving and transforming furniture elements in a safe and reliable manner.

BACKGROUND

Motor-operated, modular home and office furniture is becoming more abundant in today's world. For example, office desks provide motorized lifts to raise and lower desks, allowing both standing and sitting workspaces. Other examples include moveable walls in function rooms and conference centers, allowing reconfiguration and resizing to meet specific demands. However, such implementations are designed for industrial environments and do not consider the variety of consumer/residential environments, or other settings in which furniture is typically placed, such as hotel rooms or retail space, or more specialized environments such as hospitals or elder care facilities, or the need for user-friendly controls. Design aspects such as conveniently placed outlets and accessory lighting are overlooked, and the use of plastic or metal cable carriers may provide a robust design, but are not suitable for the everyday home and office environment. Movable furniture also presents a safety hazard as it can collide with humans and/or objects to harmful effect.

Accordingly, there is a need for improved systems and methods for operating moveable furniture and interior architectural items to accommodate its increased usage in non-industrial settings.

SUMMARY

This disclosure describes an improved moveable architectural element system and operating techniques by incorporating features that solve many of the problems in existing moveable furniture items. The improved features are implemented throughout various elements of the system, including hardware elements, controller elements, and/or software elements.

In one aspect, the invention relates to a method of operating a moveable architectural element. The method can include the steps of: (i) performing a first part of a movement of the moveable architectural element along a portion of a length of actuation using a motor; (ii) performing a second part of the movement of the moveable architectural element with a desired movement profile and, based thereon, measuring an operation parameter; (iii) comparing the measured operation parameter to a profile of the operation parameter; (iv) if a first differential between the measured operation parameter and the profile of the operation parameter exceeds a differential threshold, incrementing a first counter; and (v) if the first counter exceeds a counter threshold, adjusting the second part of the movement of the moveable architectural element.

In various embodiments of the above aspect, the profile of the operation parameter can comprise an average operation parameter or a median operation parameter. In some instances, comparing the measured operation parameter to the profile of the operation parameter can further comprise comparing the measured operation parameter to the average operation parameter. The average operation parameter can be determined based on at least one of one or more predefined values of the operation parameter and one or more previously measured operation parameters. The one or more previously measured operation parameters can comprise a subset of one or more measurements of the operation parameter, wherein each of the one or more measurements corresponds to a recent position of a threshold number of most recent positions of the moveable architectural element. The method can further include the steps of: (i) adding the measured operation parameter to the one or more previously measured operation parameters; and (ii) updating the average operation parameter. In some instances, he method can further include the step of removing, before updating the average operation parameter, an oldest measurement from the one or more previously measured operation parameters.

In various embodiments of the above aspect, the desired movement profile can comprise at least one of a speed profile and an acceleration profile. In some instances, the speed profile can comprise an approximately constant speed and the acceleration profile can comprise approximately zero acceleration. The desired movement profile can be based on a desired motor parameter profile. In some instances, the desired motor parameter profile can comprise at least one of a load profile, a speed profile, a voltage profile, a current profile, and a pulse width modulation profile. The operation parameter can comprise at least one of a load on the motor, a speed of the motor, a voltage delivered to the motor, a current delivered to the motor, and a pulse width modulation delivered to the motor. In some instances, the operation parameter can comprise the load on the motor and the load on the motor is measured as an alignment angle value. Adjusting the second part of the movement of the moveable architectural element can comprise at least one of stopping the second part of the movement, reducing a speed of the second part of the movement, and reversing a direction of the second part of the movement. The moveable architectural element can comprise a furniture item. In some instances, the operation parameter can vary along the length of actuation at least in part because of one or more objects that are positioned in a path of the furniture item along the length of actuation.

In various embodiments of the above aspect, the motor can comprise at least one of an electric DC motor and a stepper motor. The length of actuation can comprise a room surface selected from the group consisting of a floor surface, a wall surface, and a ceiling surface. If the differential between the measured operation parameter and the profile of the operation parameter does not exceed the differential threshold, the method can further include the step of resetting the first counter. The method can further include the steps of performing an additional movement of the moveable architectural element along at least a portion of the length of actuation and updating the profile of the operation parameter based on operation parameters measured during the additional movement. If a second differential between the measured operation parameter and a configured operation parameter exceeds a second differential threshold, the method can further include the step of incrementing a second counter. If the second counter exceeds a second counter threshold, the method can further include the step of adjusting the second part of the movement of the moveable architectural element. If the second differential between the measured operation parameter and a configured operation parameter does not exceed the second differential threshold, the method can further include the step of resetting the second counter.

In various embodiments of the above aspect, the method can further include the steps of: (i) performing an additional movement of the moveable architectural element along at least a portion of the length of actuation in a first direction; (ii) based on performing the additional movement of the moveable architectural element in the first direction, determining one or more first measurements of the operation parameter; (iii) determining, based on the one or more first measurements of the operation parameter, a first average value for the operation parameter; (iv) performing a second additional movement of the moveable architectural element along at least a portion of the length of actuation in a second direction; (v) based on performing the second additional movement of the moveable architectural element in the second direction, determining one or more second measurements of the operation parameter; determining, based on the one or more second measurements of the operation parameter, a second average value for the operation parameter; (vii) comparing the first average value to the second average value; and (viii) if a differential between the first average value and the second average value exceeds a third differential threshold, providing an indication to modify a counterweight coupled to the moveable architectural element. If a differential between the first average value and the second average value exceeds the third differential threshold and the first average value is greater than the second average value, the method can further include the step of providing an indication to increase a weight applied to the counterweight coupled to the moveable architectural element. If a differential between the first average value and the second average value exceeds the third differential threshold and the first average value is less than the second average value, the method can further include the step of providing an indication to reduce a weight applied to the counterweight coupled to the moveable architectural element. If a differential between the first average value and the second average value does not exceed the third differential threshold, the method can further include the step of providing an indication that the movable architectural element is balanced.

In another aspect, the invention relates to a system for operating a moveable architectural element. The system can include a motor adapted to move the moveable architectural element along a length of actuation. The system can include at least one of a controller and a data processing apparatus, programmed to perform certain operations. The operations can include: (i) performing a first part of a movement of the moveable architectural element along a portion of the length of actuation using the motor; (ii) performing a second part of the movement of the moveable architectural element with a desired movement profile and, based thereon, measuring an operation parameter; (iii) comparing the measured operation parameter to a profile of the operation parameter; (iv) if a first differential between the measured operation parameter and the profile of the operation parameter exceeds a differential threshold, incrementing a first counter; and (v) if the first counter exceeds a counter threshold, adjusting the second part of the movement of the moveable architectural element. The system can include a memory unit for storing the profile of the operation parameter.

In various embodiments of the above aspect, the profile of the operation parameter can comprise an average operation parameter or a median operation parameter. In some instances, comparing the measured operation parameter to the profile of the operation parameter can further comprise comparing the measured operation parameter to the average operation parameter. The average operation parameter can be determined based on at least one of: one or more predefined values of the operation parameter and one or more previously measured operation parameters. The one or more previously measured operation parameters can comprise a subset of one or more measurements of the operation parameter, wherein each of the one or more measurements corresponds to a recent position of a threshold number of most recent positions of the moveable architectural element. The operations can further include: (i) adding the measured operation parameter to the one or more previously measured operation parameters; and updating the average operation parameter. In some instances, the operations can further include removing, before updating the average operation parameter, an oldest measurement from the one or more previously measured operation parameters.

In various embodiments of the above aspect, the desired movement profile can comprise at least one of a speed profile and an acceleration profile. In some instances, the speed profile can comprise an approximately constant speed and the acceleration profile can comprise approximately zero acceleration. The desired movement profile can be based on a desired motor parameter profile. In some instances, the desired motor parameter profile can comprise at least one of a load profile, a speed profile, a voltage profile, a current profile, and a pulse width modulation profile. The operation parameter can comprise at least one of a load on the motor, a speed of the motor, a voltage delivered to the motor, a current delivered to the motor, and a pulse width modulation delivered to the motor. In some instances, the operation parameter can comprise the load on the motor and the load on the motor is measured as an alignment angle value. Adjusting the second part of the movement of the moveable architectural element can comprise at least one of stopping the second part of the movement, reducing a speed of the second part of the movement, and reversing a direction of the second part of the movement. The moveable architectural element can comprise a furniture item. In some instances, the operation parameter can vary along the length of actuation at least in part because of one or more objects that are positioned in a path of the furniture item along the length of actuation.

In various embodiments of the above aspect, the motor can comprise at least one of an electric DC motor and a stepper motor. The length of actuation can comprise a room surface selected from the group consisting of a floor surface, a wall surface, and a ceiling surface. If the differential between the measured operation parameter and the profile of the operation parameter does not exceed the differential threshold, the operations can further comprise resetting the first counter. The operations can further comprise performing an additional movement of the moveable architectural element along at least a portion of the length of actuation and updating the profile of the operation parameter based on operation parameters measured during the additional movement. If a second differential between the measured operation parameter and a configured operation parameter exceeds a second differential threshold, the operations can further comprise incrementing a second counter. If the second counter exceeds a second counter threshold, the operations can further comprise adjusting the second part of the movement of the moveable architectural element. If the second differential between the measured operation parameter and a configured operation parameter does not exceed the second differential threshold, the operations can further comprise resetting the second counter.

In various embodiments of the above aspect, the operations can further comprise: (i) performing an additional movement of the moveable architectural element along at least a portion of the length of actuation in a first direction; (ii) based on performing the additional movement of the moveable architectural element in the first direction, determining one or more first measurements of the operation parameter; (iii) determining, based on the one or more first measurements of the operation parameter, a first average value for the operation parameter; (iv) performing a second additional movement of the moveable architectural element along at least a portion of the length of actuation in a second direction; (v) based on performing the second additional movement of the moveable architectural element in the second direction, determining one or more second measurements of the operation parameter; (vi) determining, based on the one or more second measurements of the operation parameter, a second average value for the operation parameter; (vii) comparing the first average value to the second average value; and (viii) if a differential between the first average value and the second average value exceeds a third differential threshold, providing an indication to modify a counterweight coupled to the moveable architectural element. If a differential between the first average value and the second average value exceeds the third differential threshold and the first average value is greater than the second average value, the operations can further comprise providing an indication to increase a weight applied to the counterweight coupled to the moveable architectural element. If a differential between the first average value and the second average value exceeds the third differential threshold and the first average value is less than the second average value, the operations can further comprise providing an indication to reduce a weight applied to the counterweight coupled to the moveable architectural element. If a differential between the first average value and the second average value does not exceed the third differential threshold, the operations can further comprise providing an indication that the movable architectural element is balanced.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DETAILED DESCRIPTION

Figure 1:
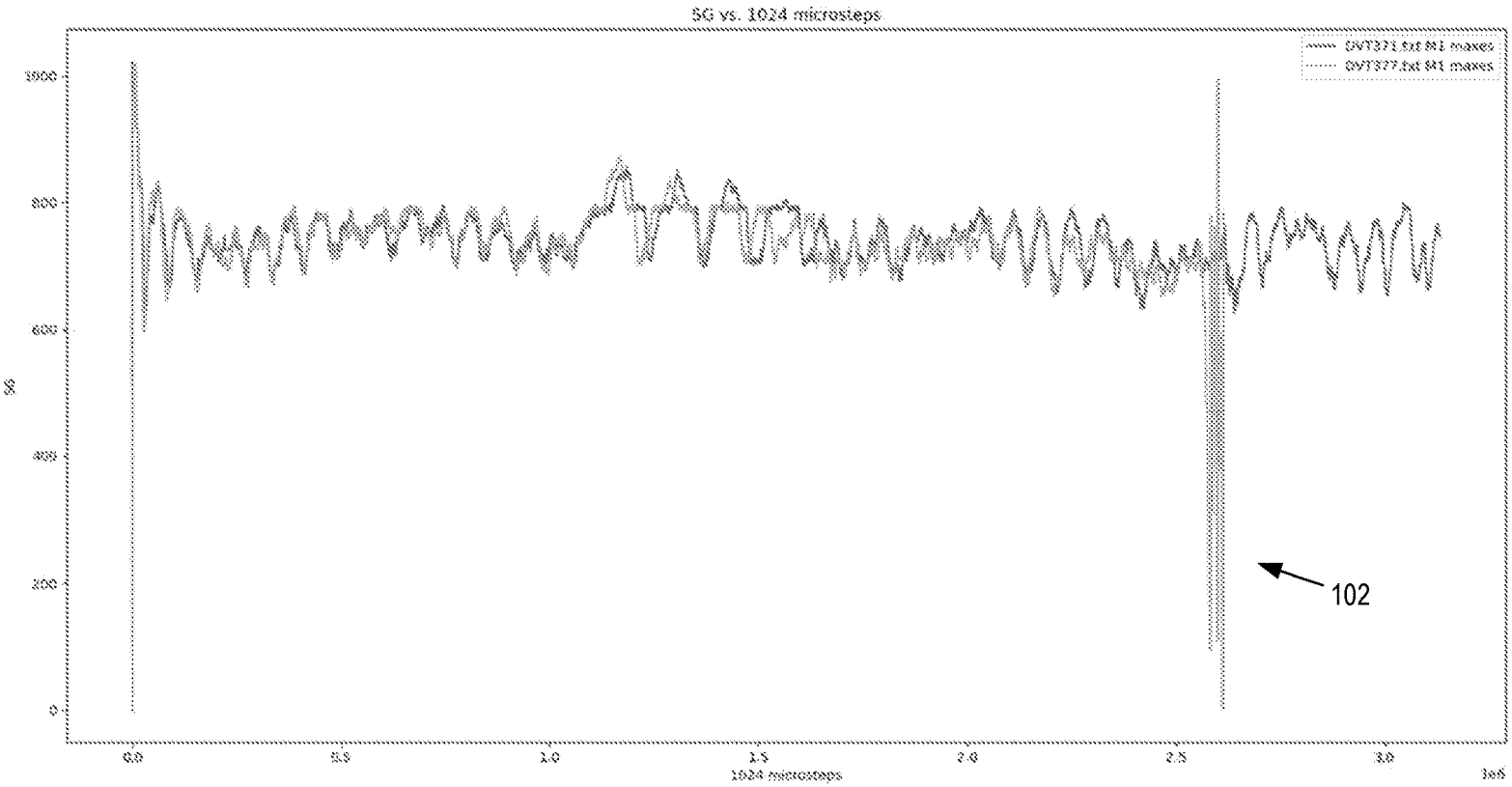
FIG. 1 shows an example of a plot of a motor load for controlling movement of an element of robotic furniture and architectural elements relative to a position of the element of the robotic furniture and architectural elements, according to various embodiments.

This disclosure describes an improved moveable furniture system and techniques for operating the system by incorporating features that solve many of the problems in existing moveable furniture items. The improved features are implemented throughout various elements of the system, including hardware elements, controller elements, and/or software elements. Although this description will often refer to movable furniture elements and, in particular, a dropdown bed furniture item, it will be understood that the concepts described herein can be applied to any moveable element, e.g., non-bed furniture items, as well as non-furniture items such as garage doors, factory equipment, pallet delivery, vehicle systems, among many other examples. Some inventions described in this application build on features described in US Patent Publication Nos. 20200256109 and 20160031090 and International Patent Publication No. WO2020097517, all of which are hereby incorporated by reference in their entireties.

The various inventive features are described in more detail under separate headings below. However, the headings are provided simply for reader convenience and do not limit the disclosure in any way. Moreover, features described under one heading can be combined with any feature described under any and all other headings in various combinations and permutations.

Within the context of certain features described below, certain aspects may be referred to using the word "requirements," This or similar words should be interpreted as such description might be used in engineering specification documents, setting forth the requirements only in certain embodiments and in certain conditions. The word requirement, or any other words in this application, should not be interpreted to limit the scope of the described or claimed invention nor to mean that in different embodiments and under different conditions, such requirements may not be required.

Load Spike Safety Algorithm

As with horizontally translating robotic furniture elements, vertically translating elements pose entrapment hazards that can result in damage to persons, objects, or animals.

The load mapping safety features and software described in US Patent Publication No. 20200256109 were designed to mitigate entrapment risks in the context of horizontally moving elements, where any or all of the load mapping safety features and software could be adapted for vertically moving elements. There are two major concerns the software may be required to handle: (1) the elements may need to maintain safe operation while moving across a variety of floors, as the floors could have poor levelness or poor unevenness, with any amount of hills and valleys in the element's length of travel, and (2) the elements may need to maintain safe operation from unloaded to fully loaded (as defined by maximum weight product requirements and specifications). This is a difficult challenge because different weights on the elements can result in non-linear changes in the torque demands experienced by the actuating motors as they drive the element across the floor.

The latest, most complete version of the load mapping safety software can achieve safe operation by storing a map of the actuating motors' load and torque demands as the element moves across the floor in both directions. With every subsequent movement, the software compares the current load and torque demands experienced by the motors with the load and torque demands experienced in the prior movement at that position and direction for each discretized position as the element moves. If there is a sufficiently large difference in load and torque demands sustained across a small distance (set of discretized positions), the software may infer an obstruction and may command a stop or reversal (e.g., immediate stop or reversal) to the motors. The software may be further required to account for additional issues. First, the elements could be actuated by drive mechanisms with slippage (e.g., friction drives). If the element and safety software is relying on open loop positioning (e.g., stepper motor steps or a relative encoder), the position estimation may become more and more erroneous as the element moves. This can result in the element moving to a wrong/undesired position, the element failing to stop when there is an obstruction without exerting unsafe levels of force (false negative), or the element stopping when there is no obstruction (false positive). Since some robotic furniture elements are actuated via friction drives, closed loop positioning may be used to remedy the above described deficiencies. In some cases, a laser may be used as a part of closed loop positioning, where the laser reports the position of the element relative to a fixed point along the element's axis of travel. Second, the laser may have some amount of measurement error and noise. In one particular exemplary embodiment, the laser may have a variance of about 5 millimeters. Third, the load and torque demand measurements may have some amount of measurement error and noise. Fourth, movement and operation of element(s) at the same position in the same direction may not be exactly the same; anything from mechanical and friction changes over time and use, to orientation angles of the element with respect to the guidance track, to variations is weight as users add and remove items onto the element in different locations will result in changes in the load and torque demands, in other embodiments, the laser can be replaced with another type of tracking mechanism.

To account for the above items, the safety software may be designed to tolerate (e.g., account for) some amount of error and noise. The safety software may have relatively large, discretized positions (bins) and may require multiple consecutive bins of large load and/or torque differentials to trigger a stop or reversal. This means that it acts on relatively slow increases in load very well, such as detecting resistance from a hand (or fingers) or a foot or a body that can deform a small amount. Faster or more instantaneous entrapment events, such as those on a non-deformable body (e.g., a furniture item against a wall), while still detected, may exert higher levels of force on the object.

While entrapment risks were reasonably and satisfactorily mitigated in the previous work for the previous moving elements, vertically movable elements (e.g., a bed) can present a different entrapment situation requiring an additional solution. For example, there is a higher risk that contact can be made against a person's head as a movable element (e.g., bed) vertically translates downward along an axis. The element and safety software may not only be required to be capable of detecting relatively slower increases in load, but the element and safety software may be further required to be able to quickly detect sharp increases in load as to minimize impact forces.

FIG. 1 shows an example of a plot 100 of a motor load for controlling movement of a robotic furniture and architectural elements relative to a position of the robotic furniture and architectural elements. As shown in FIG. 1, motor load (as indicated by "SG") can be plotted as a function of a position (i.e. "microsteps") of the element of the robotic furniture and architectural elements. The plot 100 shows how the load values abruptly spike downward in an impulse or rigid body entrapment event 102. Note that the lower the load value (y-axis of plot 100), the higher the motor load. The plot 100 shows the motor load during movement of an element of the robotic furniture and architectural elements for a first scenario where no obstruction is present and for a second scenario where an obstruction is present. A first line in the plot 100 (green) shows is a movement event with no obstruction. A second line in the plot 100 (blue) shows a movement event with an obstruction.

Impact forces are largely a function of the moving element's inertia; the higher the speed of the element, and the higher the mass, the higher the impact force. Contact-based safety features, such as those used in the element and safety software, can only mitigate so much impact force, as some amount of momentum has to be imparted unto the object for the electronics and software to notice a differential, and it takes some amount of time and travel distance for the motor(s) to achieve a stop and reversal. While a higher speed can be desirable to reduce transformation times and improve user experience, that must be balanced against the slower speed needed to effectively bring the impact forces to safe levels.

One major benefit of the vertically moving element embodiment compared to the previous horizontally moving element embodiments is that the vertically moving element moves on a manufactured track (e.g., a vertical beam coupled to a wall), which can be a more relatively stable and constant travel surface than a horizontal surface (e.g.; floor), which results in more relatively stable and constant load and torque requirements as the element moves up and down (for a given weight to lift). This enables differential thresholds to be tuned lower for the vertically moving element embodiment and the element can stop with smaller resistance forces relative to the horizontally moving element embodiments. The element may be required remain adaptable to small changes in weight on the element, as the full weight of placed objects on the element can be transferred into torque and load demand changes (as opposed to affecting rolling friction in previous horizontally moving elements). A simple, fixed load and torque demand cutoff may not be sufficient to solve the problem; neither is a fixed differential.

In the previous description of the safety software, it was described that the position of the movable element could be discretized into bins of any size using any applicable units. In an exemplary embodiment, the position can be discretized into bins of size 5 millimeters; this bin size was chosen to accommodate the laser's inherent noise and error. Additionally, the previous embodiment required 3 consecutive bins; or 15 mm, of high enough load differentials to trigger a stop.

To mitigate forces in more instantaneous entrapment events, the discretization on position may be required to be smaller. Therefore, stepper motor steps were chosen for positioning units. In this embodiment, the stepper motor drivers cam provide the most robust load and torque demand measurements 50 times per internal motor shaft revolution, or once per every 1024 steps (e.g., 1024 microsteps as shown in FIG. 1). Therefore, the bin size was chosen to be 1024 steps. Any suitable bin size may be used based on the configuration of the stepper motor. For an element (e.g., bed) of the vertically translating robotic furniture and architectural elements, this corresponds with 0.4 mm of linear travel and approximately a 10-fold reduction in bin size.

In some embodiments, the load measurement is performed using the techniques described in U.S. Patent Publication No. 20200256109, incorporated herein by reference in its entirety.

To make the problem tractable and maximize safety and user experience, the element's and software's operation was divided into three speed regions in this particular embodiment, although any number of speed and direction regions can be used depending on the application. Each region can have its own motor rotational cruising speed. In this embodiment, the speed regions are moving up quickly, moving down quickly, and moving down slowly. In this embodiment, moving up quickly and moving down quickly is approximately 3.5 revolutions per second of the internal motor shaft or approximately 2.5 inches per second of linear speed. Moving down slowly is approximately 1.75 revolutions per second or approximately 1.3 inches per second of linear speed. A published safety standard indicates that entrapment risk mitigation may be contained to 18 inches between the moving element and the hard surface to entrap against. Therefore, in the last 18 inches of downward travel, the element (e.g., bed) slows down to reduce momentum and entrapment forces. Above those 18 inches, and in all upward travel, the element (e.g., bed) travels faster. While moving quickly (both up and down), safety software is still executing to reduce entrapment forces against people, animals and objects.

Motor driving settings and characteristics, such as drive current, can be different in different speed regions and directions. Safety algorithm parameters and thresholds, such as the ones in load mapping and load spike, can be different in different speed regions and directions.

Figure 2A:
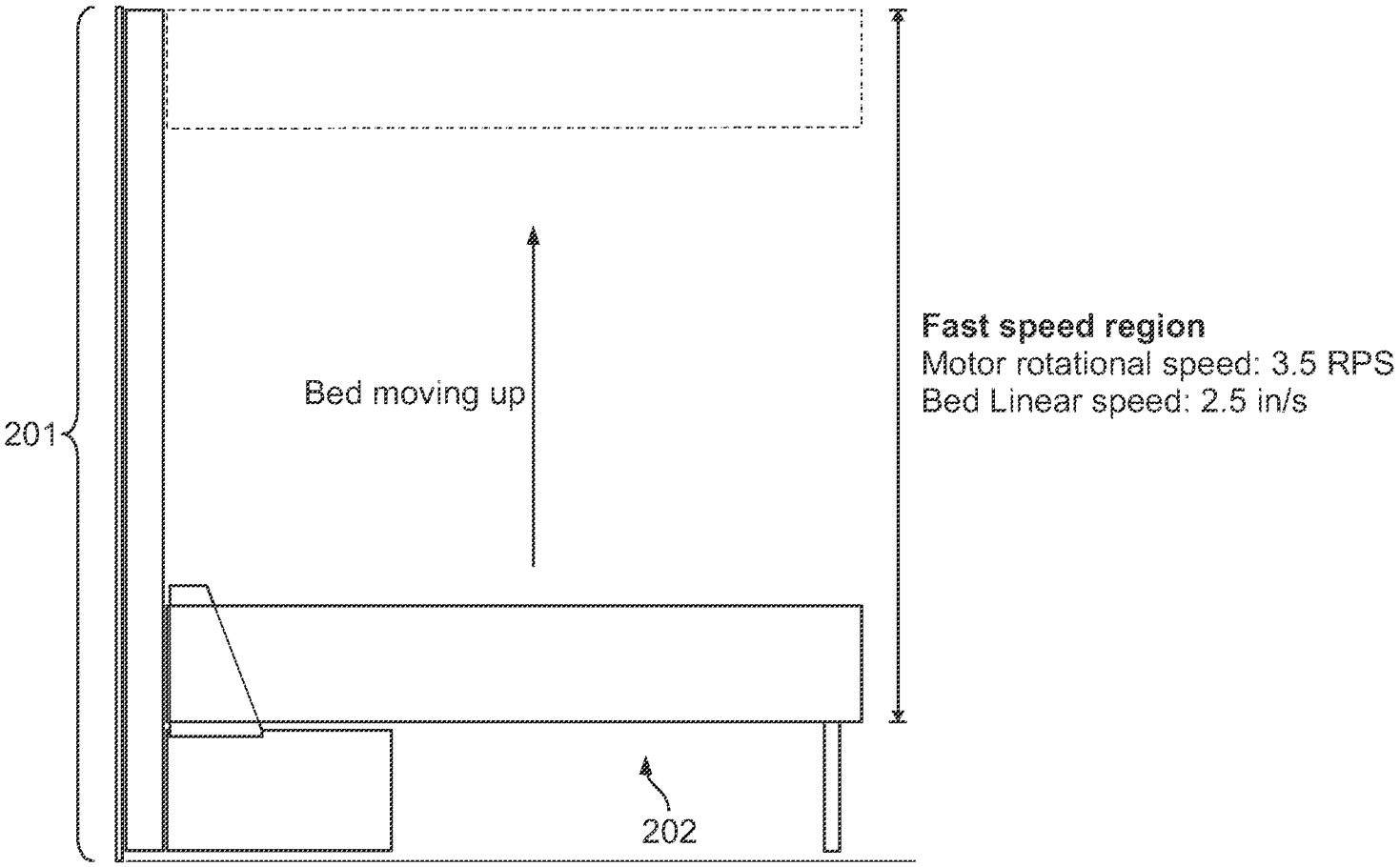
FIG. 2A shows an example of upward movement of an element of vertically translating robotic furniture and architectural elements, according to various embodiments.
Figure 2B:
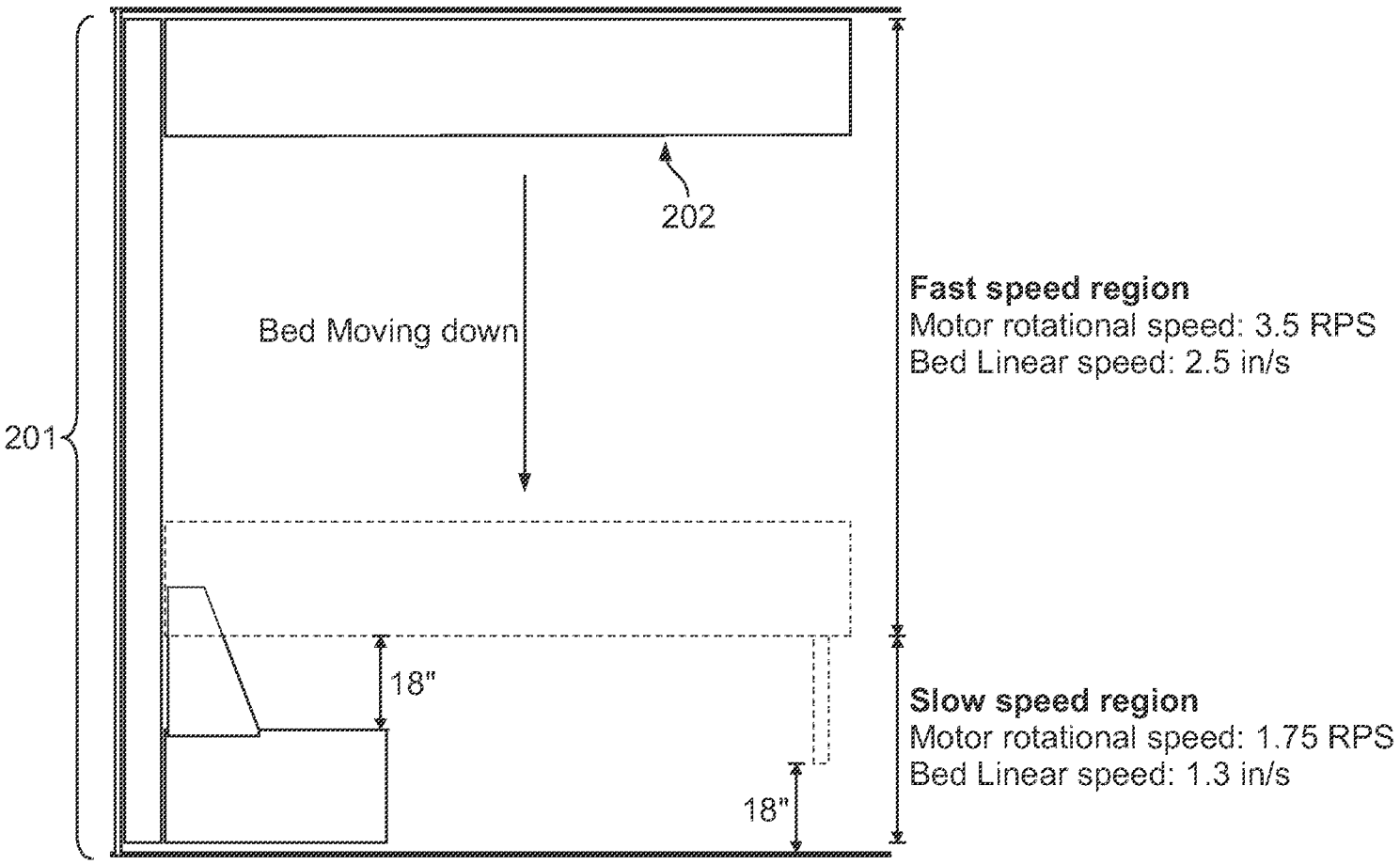
FIG. 2B shows examples of downward movement of an element of vertically translating robotic furniture and architectural elements, according to various embodiments.

FIGS. 2A and 2B show examples of movement of an element 202 of vertically translating robotic furniture and architectural elements 201. FIG. 2A shows an example of upward movement of an element 202 (e.g. bed) of vertically translating robotic furniture and architectural elements 201. As an example, the moving up quickly speed region is shown in FIG. 2A. FIG. 2B shows examples of downward movement of an element 202 (e.g., bed) of vertically translating robotic furniture and architectural elements 201. As an example, the moving down quickly and moving down slowly speed regions are shown in FIG. 2B.

Similarly to the previous safety software, the load spike safety algorithm may begin execution when the element 202 has reached cruising speed in any of the speed regions.

As with the previous load mapping safety algorithm, the current load value at the current position may be compared to a value (i.e. reference load value). For the load spike safety algorithm, the value may adhere to one or more requirements: (1) The value may be required to represent a "steady state" load, capable of filtering noise in load measurements and immune to small imperfections in the travel track; (2) The value may be required to be representative of the recent travel area of the element 202, as travel areas farther from the current position are not useful in determining load spikes in the current area of travel of the element 202; (3) The value should avoid representing the immediate location of travel, as the value would change with large spikes in load to reduce the comparison differential.

Any discrete statistical tool, with the appropriate modifications, that meets the requirements for the comparison value may be used; examples include moving averages, moving medians, and use of variance or standard deviations. In this embodiment, a moving average is used.

The load spike safety algorithm can operate primarily by using a moving average of one or more of the most recent load values. By comparing the current load value at the current position with the moving average of loads in the most recent previous positions, the load spike safety algorithm can detect a sharp increase, or spike, in the load. Slower moving changes in load on the other hand are incorporated into the moving average, and noise and error is mitigated (e.g., smoothed out) by the moving average.

In this embodiment, the load spike safety algorithm stores the loads values corresponding to the most recent 100 discretized positions (i.e. bins) of the element 202; however, any number of bins appropriate for the application, goals, and capability of the hardware and software can be used. For the element 202 (e.g., bed) shown in FIGS. 2A and 2B, the combination of the 100 discretized positions corresponds to approximately 2 revolutions of the internal motor shaft and to approximately 40 mm of linear travel.

In this embodiment, the moving average of one or more of the most recent load values may be calculated by taking the average of the oldest 87 bins (or any other suitable number of bins) that were stored for the most recent 100 discretized positions; however, any number of bins that provide satisfactory results could have been used. In some cases, using the relatively older bins from the sample of the most recent bins (e.g., loads values at the most recent 100 discretized positions) can improve performance of the load spike algorithm. As an example, in this embodiment, the moving average does not use the load values corresponding to the newest 13 bins (or any other suitable number) of the most recent 100 discretized positions. Using only the older bins (and not using the newer bins) can limit a sharp increase in load values (e.g., corresponding to the newer bins) from affecting the moving average too quickly to be able to identify proper differentials and trigger a stop of the element 202.

The moving average and/or moving average array/bins may be initialized at the start of motion of the element 202. The moving average and/or moving average array/bins may be initialized in such a way as to provide the fastest transition to steady state operation of the load spike algorithm as possible, while mitigating the chance of a false positive or a false negative for detecting an obstruction. The bins may be pre-filled when the first load value in cruising speed is obtained. In this embodiment, they are prefilled with a predefined load value, or the current load value if it indicates more load, so as to reduce the likelihood of an immediate false positive while still allowing the algorithm to execute and mitigate entrapment forces. However, any strategy for initializing the relevant variables and bins may used.

Every 1024 steps (or any other suitable number of steps), a new load value is obtained and inserted into the 100-long bin array, while the oldest value in the 100-long bin array is removed. The moving average may then be calculated as described herein. A threshold of load over the moving average is established based on the value of the moving average. Similarly to the wag and reasons described in U.S. Patent Publication No. 20200256109 for choosing a dynamic/variable threshold, this is done because motors under low steady-state load can have smaller thresholds per resistance force, while motors under higher steady-state load must have larger thresholds per resistance force, as the same resistance force manifests itself in higher differentials in higher steady-state load situations. If the difference between the current load measurement and the calculated moving average does not exceed the threshold, a counter is reset. If it does exceed the threshold, the counter is incremented. If the counter exceeds a certain predefined value (representing the number of consecutive readings/bins that must exceed the threshold to trigger a stop), the element is commanded to execute an immediate reversal of the motor for a small back off distance. In this particular embodiment, the counter may equal 2 (bins), such that an entrapment is identified (e.g., registered) over 0.8 mm.

As an added layer of safety, the load spike safety algorithm may command a stop and reversal (e.g., an immediate stop and reversal) of the element 202 if the current load value exceeds a configured fixed value. This can be any value found to work well for the particular application and load, torque, and speed demands. In this particular embodiment, the threshold was chosen to be near the motor's physical and electrical torque limitations for the desired speeds and current. Similar to the moving average as described herein, this particular embodiment may use a counter to require any suitable number (e.g., 2) consecutive bins of breaching load (e.g., where the current load value exceeds the threshold load value) before a stop of the element 202 is commanded.

The load spike safety algorithm can be applied to (execute in) all or only some of the speed regions of the application. Moreover, the parameters and thresholds can be set differently in different speed regions. Speed affects load readings significantly, so the way variable thresholds are chosen can additionally be different based on the configured speeds of the element 202. Accordingly, to maintain proper and safe operation, variables and arrays can be initialized differently based on the element 202 entering different speed regions.

The load spike safety algorithm can effectively mitigate impact forces, which are sharp and fast. The load spike safety algorithm may not effectively mitigate relatively slow resistance forces, such as hands, feet, and any other deformable body that are pushing back against the element. The moving average will follow (e.g., too quickly follow) changes in load resulting from slow resistance forces, such that differentials between a current load value and the moving average will not exceed the threshold.

However, this shortfall is effectively mitigated by the previous load mapping safety algorithm (from U.S. Patent Publication No. 20200256109). For this embodiment, the load mapping safety algorithm can be adapted to execute in parallel alongside the load spike safety algorithm. The load mapping safety algorithm may be changed to monitor the single motor driving the element 202 (e.g., bed) of the vertically translating robotic furniture and architectural elements (as opposed to the two motors driving the element(s) of horizontally translating robotic furniture and architectural elements), and tuned for the different speeds and loads experienced by the element 202. The load spike safety algorithm and the load mapping safety algorithm can be adapted to operate with any number of motors, speeds, and loads.

The load mapping safety algorithm may be adapted to execute in multiple speed regions. This includes handling of acceleration and deceleration events, initialization of variables and arrays at the start of constant (e.g., cruising) speed motion, the use of different thresholds and variable thresholds in different speed regions, and the storage of load values from different speed regions, particularly after motion through multiple speed regions, into non-volatile memory (e.g., as described with respect to FIG. 11).

After tuning, the load mapping safety algorithm may effectively mitigate entrapment (e.g. slow resistance) forces such as those exerted by a user's hand and the user is effectively able to stop and reverse the element 202 (e.g., bed) using light pushes or pull with the hand.

Motion Avoidance in Moveable Robotic Elements Using Person and Animal Detection

In applications with movable robotic elements capable of injuring people or animals, person and animal avoidance is paramount for safety. Avoidance can entail that the elements (e.g., element 202) move away or around people or animals or don't move at all or even power down motors until they are no longer detected. There are a variety of sensors that could detect people or animals in some form or fashion, such as heat sensing (passive infrared sensors, for example), sonar, LIDAR, and cameras with machine vision; these solutions each have their advantages and limitations in terms of capabilities and cost, and different applications can be better suited to different sensing.

Some embodiments of movable robotic elements described herein do not avoid people or animals. Instead, they employ contact-based sensing and use software to mitigate entrapment forces and hazards. In other words, they can run into people or animals but avoid exerting unsafe levels of force on them.

While these current solutions are effective for mitigating entrapment hazards, user experience, perception of safety, and actual safety would be improved if there were a contactless sensing solution, where no force would be exerted on the person or animal. Moreover, some non-entrapment hazards could be mitigated with such an avoidance solution. For example, in an embodiment of the element 202 (e.g., bed) in the vertically translating robotic furniture and architectural elements, the element 202 (e.g., bed) has some overhead torque in order to lift different, user-specific types of bedding, and also to overcome mechanical wear over time. While this overhead torque is not sufficient to lift most children and heavy pets, in some cases it may be sufficient to lift babies and light pets. While there is no entrapment hazard in this situation, it can be potentially dangerous to have the baby or pet elevated to the top height of the element 202. With an avoidance solution, the element 202 could refuse to lift if a human or animal is detected on the element 202.

One of the most cost effective sensing solutions, and the primary embodiment chosen for this invention, is heat sensing via passive infrared sensors (PIR). The sensors detect infrared waves, such as those radiated out by warm bodies (e.g., people and animals). They range in cost and capabilities, from a single-pixel sensor to a camera.

One of the challenges of using PIRs is that they can be triggered by multiple sources of infrared light, not just people or animals. Sunlight coming through windows, heat radiators against walls and under floors, appliances, and electronics can all emit infrared radiation. Moreover, the radiation can reflect off floors and walls or objects in view, depending on the materials. That can lead to a moving element believing there is a person or animal in the travel path when there is none (false positive). Use of PIRs was investigated as an avoidance solution in horizontally moving elements, with one or more PIR sensors mounted on the element and aimed at the element's path, but the investigation determined that the probability of false positives were high, as the PIR sensors would be exposed to different parts and angles of floors, walls, and windows.

A solution is needed to determine when there is a person or animal on the moving element or in the moving element's path. The requirements are: (1) The solution must have few to no false positives; otherwise, the product and user experience is not viable, and it is better to have a contact-based solution only. This may mean that additional software/firmware is required to provide signal processing and filtering. This may also imply that not all moving elements will be compatible with the solution. In cases where the solution works much better in some environments than others, and the sensors are installed, there should be a way to override the sensors; (2) The solution should ideally prevent movement of the element(s) when a person or animal is on the moving element or in the moving element's path. If a detection happens when the moving element is in motion, the moving element should come to an immediate stop. If appropriate, an immediate reversal of the moving element may also be executed; and (3) The solution must be cost-effective and as easy as possible to integrate into the product and software/firmware.

The challenges described above are very relevant to horizontally moving elements with sensors mounted on the moving elements, where the sensors would move through different parts of the space. PIR sensors may be suited to work better in vertically moving elements. That is because the sensors can be affixed to a static/non-moving elements and monitor the moving element's travel area more effectively than for horizontally moving products. Additionally, if the sensors were affixed to the vertically moving element, the surface area to monitor can be much more limited (a small part of the floor only, for example). Additionally, in horizontally moving elements, it is less hazardous to have a person or animal on the moving element. In vertically moving elements, it is more hazardous; the person or animal can fall and injure themselves from height. Accordingly, the first primary embodiment of the sensing solution may be applied to a vertically moving element (e.g., element 202) of vertically translating robotic furniture and architectural elements.

As mentioned earlier, PIR sensors are one of the most cost effective solutions for heat, person, and animal sensing, albeit with caveats such as low specificity and some potential for false positives depending on the application and environment. They can also be operationally simplistic, which can be positive or negative depending on the application. Some of the most simplistic sensors include a sensor with a single signal wire that is in one state when the sensor detects infrared and in another state when the sensor does not detect infrared. Some of the most complex sensors are cameras that can include artificial intelligence or machine learning to differentiate heat sources (e.g., people vs. appliances).

In some embodiments, one or more other sensors can be substituted for (or included with) PIR sensors and can be used to achieve similar or better performance, per the application. Different sensor types may be better suited to different products, applications, and moving elements. Many of the concepts around detection and signal processing apply very similarly to different sensor types, and detection should induce the same safety behaviors in the moving elements.

Different moving element products may have different numbers of PIR sensors appropriate for the application. Any number of sensors appropriate for the application may be placed on/towards one or both sides of travel and on static or moving elements or both. The sensors may be angled towards areas that need to be monitored based on the application and sensor capabilities.

The pixel count of the sensor(s) can vary depending on the application. It can also vary from sensor to sensor in the same application. Multiple-pixel sensors may allow for processing on a pixel-by-pixel basis. In moving element applications (e.g., as described with respect to the element 202), the most important consideration max be area of coverage by the sensor. If high resolution is not needed, or if different regions of the area of coverage do not need different processing based on element position and state, low pixel counts can be used, such as one. In vertically moving element applications, if the sensor is mounted on the moving element, the area that needs monitoring can be expected to change as the element moves through the space: in this case, the number of pixels monitored should change as the area changes. If the sensor is mounted on a fixed element and the moving element(s) enter the area of coverage of the sensor, the pixels monitored for that sensor would need to be adjusted so that the moving element does not cause false positives.

To limit the probability of false positives, signal processing and filtering may be required. Depending on the sensor, each pixel may have either a binary state (detection or no detection), or an analog state, in which a value with a certain range is output which correlates with the intensity of the infrared light hitting the pixel. Signal processing and filtering is especially important for analog sensors to suppress noise and avoid erroneous transient detections. Most sensors with binary states actually measure analog values and do the signal processing themselves to produce the binary on/off state. Binary state sensors may be more desirable when simplicity and ease of implementation is valued; analog sensors are more desirable when the light intensity information is desired, as well as when more complexity and customization is needed.

In both cases, filtering may be desirable on the sensor output values. Different types of software filters may be used to filter sensor output values, such as averaging filters and median filters. Any filter appropriate for the sensor, sensor output, and application can be used; different filters can be used on the same sensor depending on element position and state, and different filters can be used on different sensors in the same application as well.

Some sensors may include built-in recalibration or desensitization. This means that, in cases where the sensor or pixels report binary states, infrared light on a pixel, while first being reported as an on state, may eventually be changed to an off state, until the intensity increases, or until it decreases then increases again. This is especially important in applications where it is desired to detect motion of a person or animal (or a part of them), and where the result of an on state is configured to be a temporary output; sensors in bathroom sinks and toilets are examples of sensors where the result of an on state is configured to be a temporary output.

In moving element applications, desensitization may reduce false positives and may increase false negatives. Desensitization may allow the element to move when an infrared source is not a person or animal, such as a fixed appliance, or a reflection off the floor or wall. However, it may also allow the element to move when there has been a person or animal in the same position without moving on the moving element or its path for a while. Desensitization can be applied judiciously on a pixel-by-pixel and sensor-by-sensor basis based on the application and moving element position and state. For example, in the case of the element 202 (e.g., bed), reflections and other sources of infrared are unlikely to be seen over the mattress, while there is a high likelihood that people or animals on the element 202 (e.g., bed) will be stationary for long periods of time, so desensitization would not be applied to those sensors and pixels reading the area of the mattress. However, desensitization may be desirable when monitoring the area (e.g., floor) under the element 202 (e.g., bed).

In vertically moving furniture elements, such that those for residential use that are intended to be used by and around people but not lifted by them, the moving element (e.g., element 202) and actuating motor(s) may be designed with limited torque and small overhead. This is to prevent the moving element from having enough torque to move most people and animals upward and/or downward. However, the element 202 (e.g., bed) may have enough torque to lift an infant (or pet) with the element 202. Such a situation presents a hazard if the infant (or pet) requires attention or falls.

The following sections will describe the sensing solution in the context of a movable element (e.g., element 202) of vertically translating robotic furniture and architectural elements. The element may be a movable (e.g., vertically translating) bed as described herein. While the examples detailed are specific to the element, the general concepts and applications can be adapted to other furniture moving elements as appropriate, especially vertically moving ones.

Figure 3:
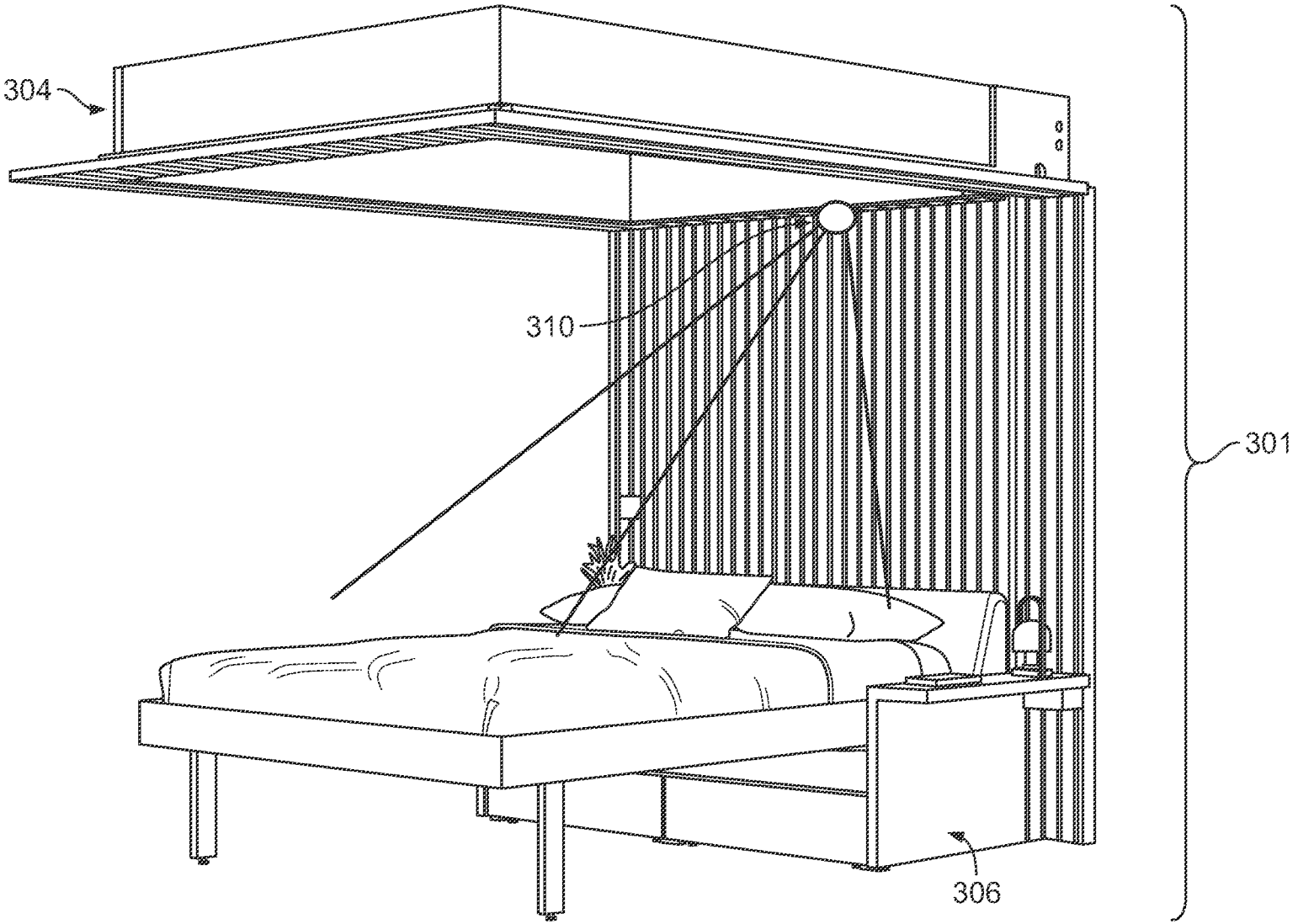
FIG. 3 shows an exemplary sensor placement and coverage area for an element of vertically translating robotic furniture and architectural elements, according to various embodiments.

FIG. 3 shows an exemplary sensor placement and coverage area for an element 302 of vertically translating robotic furniture and architectural elements 301. Multiple sensors can be placed at multiple locations and angles for different coverage areas.

The vertically translating robotic furniture and architectural elements 301 may include a sensor 310 mounted on the canopy 304 of the vertically translating robotic furniture and architectural elements 301, where the canopy 304 is a static element. The sensor 310 may be positioned on any suitable location of the vertically translating robotic furniture and architectural elements 301. The sensor 310 may be a PIR sensor or any, other suitable sensor as described herein. The sensor 310 (and any other sensor) may be communicatively coupled to a controller (not shown in FIG. 3). The controller may control (e.g., stop or reverse) the movement of the element 302 based on communications from the sensor 310 (or another sensor). When the element 302 is down (as shown in FIG. 3), the sensor 310 can detect if a person or animal is on the element 302. If the sensor 310 detects a person or animal on the element 302, the controller may be configured to not move the element 302 until the person or animal is no longer on the element 302, or the sensor 310 is overridden by the user (if the embodiment allows for it). When the element 302 is up (not shown in FIG. 3), the sensor 310 can detect if a person or animal is in the path of the element 302, like on a sofa 306, and similarly refuse to move. If the element 302 is moving downward, the sensor 310 may be configured to not stop movement once the element 302 has blocked coverage of the area below the element 302 from the sensor 310. Similarly, if the element 302 is moving upward, the controller may be configured to not inhibit movement of the element 302 once the sensing coverage area (e.g., as provided by the sensor 310) is no longer the surface of the element 302.

The sensing coverage area provided by the sensor 310 may be configured to include all or most of the surface of the element 302. The sensing coverage area may be configured to include little to no area past the surface of the element 302. For cases in which the sensor 310 only monitors part of the surface of the element 302, one or more additional sensors be used to collectively cover (i.e. view) the entire surface of the element 302. Multiple sensors may also be warranted when the cost of implementing multiple sensors that cannot achieve full coverage by themselves is lower than the cost of less sensors or a single sensor that can achieve full coverage. When one sensor identifies an object, the element 302 may be configured to stop or to stop and reverse as appropriate.

Placing sensors on moving elements (e.g., element 302) can be more challenging and require additional configuration to handle appropriate sensing in all element states and positions. Also note that not all elements and directions of travel will work well with PIR sensors on moving elements. As an example, in horizontally moving elements, the probability of fixed sources their reflections) of infrared coming into or out of view as the element moves can be high. In the case of the element 302, a sensor (e.g., PIR sensor) may not be required to be facing upward from the element 302, as the sensor 310 pointing down from the canopy 304 may monitor the area (e.g., surface of the element 302). In some cases, a sensor (e.g., KR sensor) may be positioned on the underside of the element 302. When the element 302 is moving downward from the canopy 304, a sensor (not shown in FIG. 3) can be monitoring the area and can cause an immediate stop and reversal of the element 302 if an object (e.g., person or animal) comes into view. Such a functionality can be used for instances where the sensor 310 is inhibited from viewing the area of the element 302 (e.g., due to the element 302 being proximal or adjacent to the sensor 310).

As in fixed element placement, multiple sensors can be used as appropriate for full coverage. In this particular application, being able to change the size of the area of coverage (e.g., the area monitored by the sensor 310) can be useful. When the element 302 is located in an upward position (e.g., adjacent to or within the canopy 304), the area below the element 302 that may require monitoring may not be within the maximum coverage area provided by the sensor 310, as the path of the element 302 may only be a part of the maximum coverage area. As the element 302 moves downward from the upward position, the path of the element 302 as an area in the field of view of the sensor 310 would expand, such that the area being monitored by the sensor 310 may be configured expand to match as needed and as possible for the sensor 310 (and one or more other sensors). The controller may be configured to change which and how many pixels monitored by each sensor, such that certain sensors may monitor or not monitor depending on position and state of each of the sensors and the element 302.

Note that contactless sensing may supplement contact-based sensing as described herein. The software for contactless and contact-based sensing can executed together. Contact-based sensing may be used to bridge any false negative gap for con tactless sensing and may provide safety in moving element states or positions where the sensors (e.g., sensor 310) may not be able to provide full coverage, even momentarily.

Weight Change Prediction

In applications where moving elements (e.g., element 202 and/or element 302) are powered by motors, and where the load on those motors can be monitored, such as with stepper motors, and where safety features, such as mitigating entrapment hazards, depend on load monitoring or torque limitation, variable weight on the moving elements (e.g., affecting motor load) can reduce the effectiveness of the safety features described herein, either by increasing false detections of obstructions and/or by increasing missed detections of obstructions.

The load mapping safety features and software described in US Patent Publication No. 20200256109 were designed to mitigate entrapment risks in the context of motor-powered moving elements. The elements are required to maintain safe operation from unloaded to fully loaded (as defined by maximum weight product requirements and specifications). This is a difficult challenge because different weights on the elements result in non-linear changes in the torque demands experienced by the actuating motors as they drive the element across the floor.

Presently, for horizontally translating robotic furniture and architectural elements, the load mapping safety software achieved safe operation by storing a map (e.g., an array) of the actuating motors' load and torque demands as the element moves across the floor in both directions. With every subsequent movement, the software compares the current load and torque demands experienced by the motors with the load and torque demands experienced in the prior movement at that position and direction for each discretized position as the element moves. If there is a sufficiently large difference in load and torque demands sustained across a small distance (e.g., a set of discretized positions), the software infers an obstruction and commands an immediate stop or reversal to the motors.

When a moving element creates a map with very little added weight on the element, and then some amount of weight is added to the element, there can be a significant steady-differential in load values of the next motion compared to the previous motion. The load mapping safety algorithm can interpret this differential to be an entrapment, which would cause an immediate stop and reversal to be executed (false positive). This can result in poor user experience, especially if this behavior is happening repeatedly and there are no user-friendly methods to replace the map with the new load values.

When a moving element creates a map with a significant amount of weight on the element, especially near the element's maximum rated weight, and then the weight is removed, there can be a significant steady-state differential in load values of the next motion compared to the previous motion. In this case, a higher amount of resistance force from an obstruction would be required to overcome this differential and then exceed the threshold before the load mapping safety algorithm can interpret this differential to be an entrapment; this resistance force may be higher than those allowed by a published safety standard (false negative). This could result in high levels of entrapment force against an obstruction and potentially injure a person or animal. If the map is rewritten on every motion, which is the case in present embodiments of horizontally translating robotic furniture and architectural elements, this potential safety hazard would only be present for the single cycle of motion following weight removal.

Figure 4:
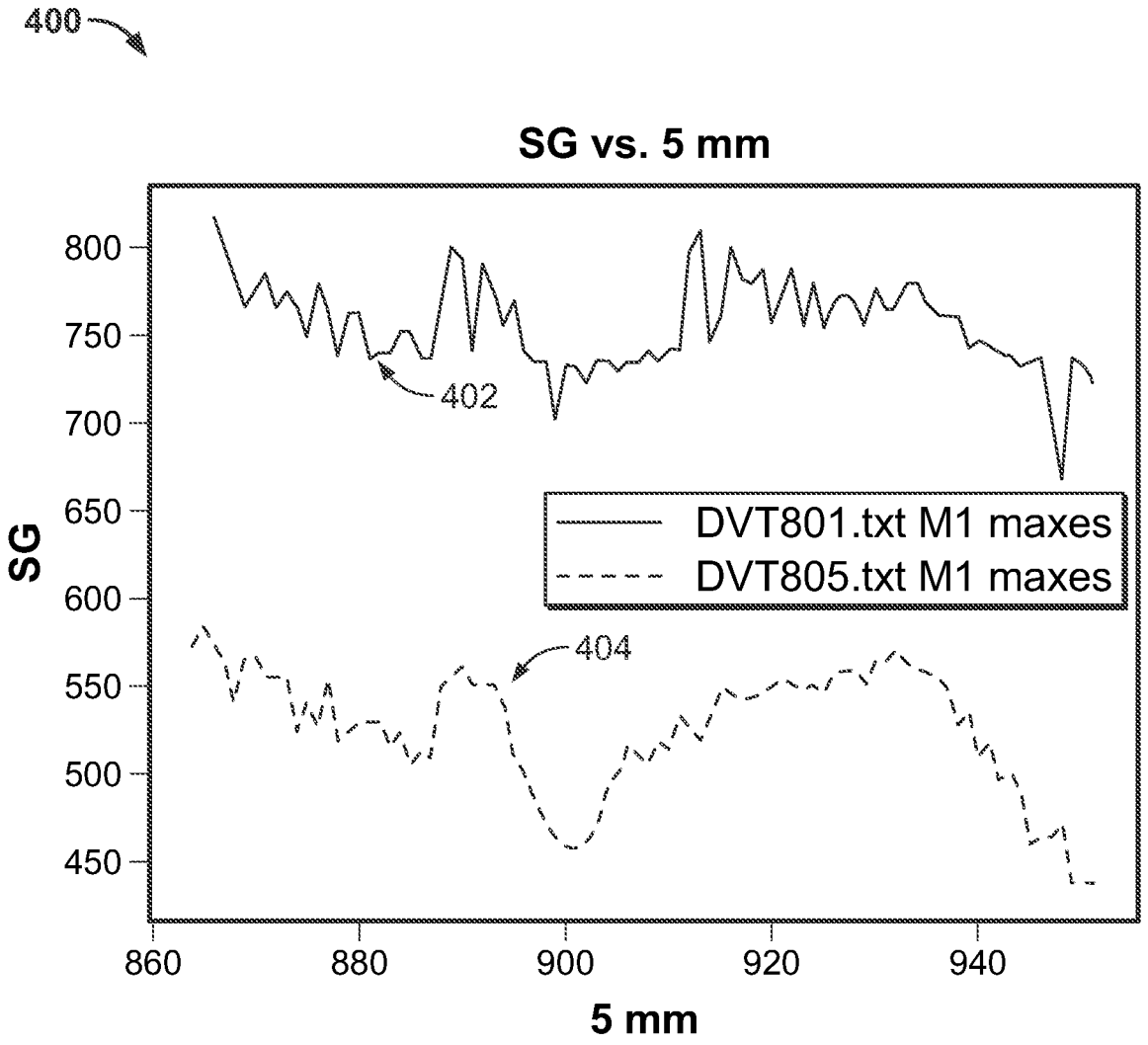
FIG. 4 shows an example of a plot of a motor load for controlling movement of a robotic furniture and architectural elements relative to a position of an element of the robotic furniture and architectural elements, according to various embodiments.

FIG. 4 shows an example of a plot 400 of a motor load for controlling movement of an element of robotic furniture and architectural elements relative to a position of an element of the robotic furniture and architectural elements. As shown in FIG. 4, motor load (as indicated by "SG") can be plotted as a function of a position (i.e. "5 mm") of the element of the robotic furniture and architectural elements. The plot 400 shows the motor load values as a function of the movable element's position for a first scenario where there is little to no weight added to the moving element of the robotic furniture and a second scenario where there is significant weight added to the moving element of the robotic furniture. Note that the lower the load value (y-axis of plat 400), the higher the motor load. The line 402 can represent motor load values as a function of the movable element's position with little to no added weight; the line 404 can represent motor load values as a function of the movable element's position with significant added weight.

A solution is needed to estimate the steady-state weight change on the moving element at the start of each motion (e.g., vertical or horizontal translation), such that the load mapping safety algorithm can account for steady-state weight change and adjust thresholds (e.g., thresholds to stop and/or reverse motion) accordingly. In some embodiments, the requirements may include: for a situation where weight is removed from the element, false negatives should be minimized or eliminated (e.g., to maintain entrapment safety); and for a situation where weight is added to the element, false positives should be minimized as much as possible (e.g., to maintain an acceptable user experience).

The weight change estimation may be configured to be a function of differences of the load values of the current (i.e. present) motion compared to the load values of the previous motion (at the same positions and direction).

The weight change estimation can use a single comparison at a single position in the motion of a movable element, or can continuously be updated using comparisons at any or all positions in the motion of the movable element. Each of the comparisons between load values during the current motion and the previous motion(s) can be aggregated using any suitable statistical tool(s) in any suitable combinations.

In some embodiments, using a single comparison at a single position of the movable element may not be adequate for the application, as any single position and differential may not be representative of the steady-state load difference. In other embodiments; using differentials at all positions of the movable element during its motion may be satisfactory, but care must be taken to avoid a true resistance force from skewing the weight change estimation in real time, especially if the entrapment occurs and/or is otherwise present early in the movement event.

In some embodiments, the weight change estimation may use a limited sample of differentials at the start of constant speed (e.g., cruising speed) motion. By using the limited sample of differentials, a single differential at a particular position may not skew the weight change estimation to be inaccurate. Configuring a weight change estimation to be based on all differentials through all the motion of the movable element was determined to ne unnecessary; the weight change estimation can become representative with a limited sample, and using a limited sample may prevent a true resistance force from skewing the weight change estimation.

In some embodiments, the sample size may be configured to be 30 positions (or any other suitable number of positions). The sample size may be configured to only include the positions where the movable element is moving with constant speed motion. For example, the sample size may include the initial positions Where the movable element is moving with constant speed motion. The weight change can be estimated over 30 5 mm bins at the start of constant speed motion, or over the first 150 millimeters of constant speed motion. However, any sample size appropriate for the application can be used. This size was found to be adequately representative of the steady-state load difference, while providing a fast weight change estimation for the load mapping safety algorithm to rely on.

In some embodiments, the load differential (i.e. weight change) can be calculated by averaging the each of the collected samples. As an example; the load differential may be calculated based on an average of the sampled differentials at each of the initial 30 positions of the movable element at constant speed motion (e.g., approximately constant speed motion) as described herein.

The sampling and averaging of the differentials at one or more (e.g., 30) positions may be performed using software, where the software uses an array to store the samples and a variable to track the number samples have been recorded. The software may calculate an average load differential using the recorded samples.

In some embodiments, at the start of motion, there can be multiple strategies for generating and using a weight change value for when there is only one sample, when there are multiple recorded samples (but not the full amount of samples), and when there are all (e.g., the sample size) recorded samples. One option is to determine an average weight change value using only the number of filled samples. Another option is to prefill the samples (e.g., 30 samples) with a value (i.e. prefilled value) and determine an average using the full sample size, updating the sample values (e.g., from prefilled to recorded values) as motion progresses. The prefilled value can be a fixed or generated value. For a prefilled value that is fixed, it can be representative of the maximum expected weight differential for the moving element, no weight differential (0), or any other suitable weight differential value. For a prefilled value that is generated, it can be based on the first sample or the latest sample.

In this embodiment, a fixed, prefilled value may be used to determine the average weight change value when less than the configured number of samples have been recorded. Use of a generated value based on a single value can introduce skewed outcomes to the average weight change value. Because the load measurements (and differentials) can be volatile after acceleration of the movable element and since the movable element's velocity and momentum may be in the process of stabilizing, it may be preferred to use a fixed, prefilled value representative of the maximum expected weight differential; this avoids determining too low of a weight change estimation and potentially identifying a false positive at the start of constant speed motion of the movable element, especially in the cases where there is added weight on the moving element.

On every transition from one discretized position bin to the next discretized position (e.g., fourth position to fifth position), the differential in load values may be added to an array storing the each of samples. Based on the addition of the differential to the array, a new weight change value may be determined (e.g., calculated) by averaging all of the samples. With each updated value added into the array, the calculated weight change value becomes more representative of the steady-state change in weight/load on the moving element between the current movement and the previous movement. Once the desired number of samples are collected, the weight change estimation can determined. In this embodiment, the weight change estimation value is stored (e.g., saved into a variable), such that the weight change estimation does not need to be determined (e.g., calculated) for each iteration of the load mapping safety algorithm.

In some embodiments, at every discretized position bin as the moving element travels in constant speed motion, the load mapping safety algorithm compares the current (i.e. present) load value of the motor (or other suitable actuator) with a previous load value identified at that position and direction. If the difference between the current load value and the previous load value exceeds a threshold, an entrapment is identified (e.g., inferred) and a stop and/or reversal (e.g., immediate stop and reversal) is commanded. The threshold can be configured as a function of one or more parameters and/or quantities. As an example, the threshold can be configured as a function of the current load measurement, the previous load measurement, and the determine (e.g., calculated) weight change value. In one embodiment, the threshold may be configured based on the previous load value and the calculated weight change. The threshold may be configured to be variable (e.g., based previous load value and the calculated weight change) because in higher loaded motors, changes in load and resistance can result in higher deviations in the variable used to indirectly measure the load, so higher thresholds may be needed to avoid false positives from non-entrapment sources of changes in load and resistance (e.g., imperfections in travel surfaces). Lower loaded motors may use lower thresholds. Since the steady-state motor load can be approximated by the previous load measurement adjusted by the calculated weight change, the threshold may be a function of the sum of the two (e.g., the weight change value could be negative if weight was removed from the moving element). In one embodiment, this weight change value can be different for any suitable number of samples that is less than the configured number of samples (e.g., first 30 position bins) of each constant-speed motion; the weight change value may be fixed after the configured number of samples are collected.

With regard to the determined (e.g., calculated) weight change value, one or more additional strategies may be used to further reduce false positives and/or false negatives. Such strategies can be useful at the start of motion (e.g., constant motion) when the sampling of the load values to determine the weight change value is in progress. In some cases, the weight change value can have a maximum configured value. Use of the maximum configured value may prevent the threshold from being made too large and risking a false negative. Use of the maximum configured value may mitigate against instances where the differentials are large during settling of the true velocity and momentum of the movable element. Use of the maximum configured value may mitigate against instances where there is an entrapment event while the sampling is still occurring. In some cases, the weight change value can have a minimum configured value. Use of the minimum configured value may prevent the threshold from being too small or decreased too much and risking a false positive. Use of the minimum configured value may mitigate against instances Where weight is removed from the moving element. Furthermore, the weight change value can be increased or decreased based on Whether the value is positive or negative and on the application of the movable element in the robotic furniture.

Modified Scissor Lift

Figure 5:
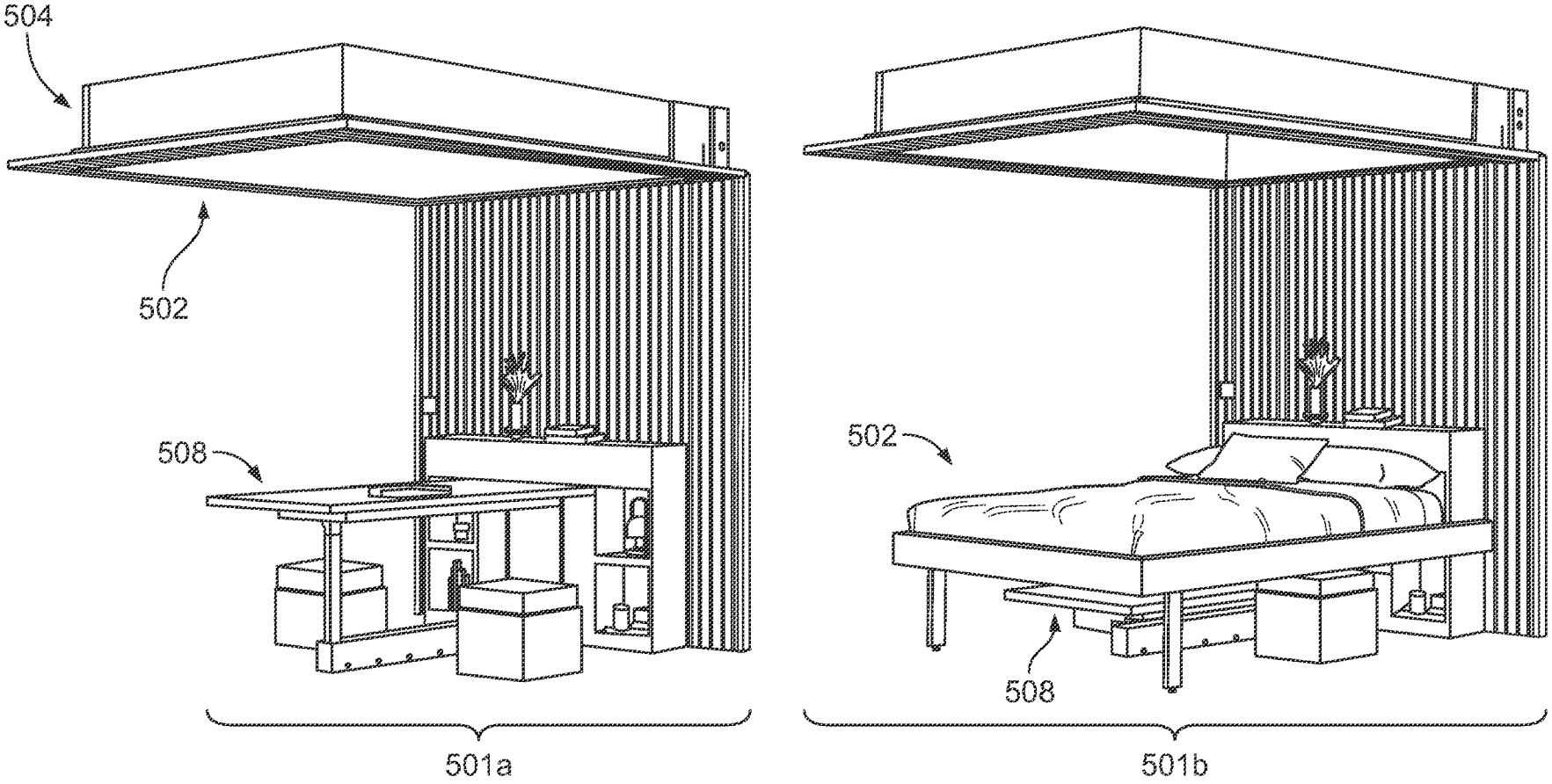
FIG. 5 shows exemplary configurations of elements of vertically translating robotic furniture and architectural elements, according to various embodiments.

In some embodiments, a configuration (e.g., bedroom configuration) of vertically translating robotic furniture and architectural elements can be configured as a table that can serve as a dining table or as a large desk (among any other suitable use). This product can include a movable element (e.g., a motorized, cantilevered bed of any suitable size) that can be vertically translated upward (e.g., to a ceiling) and downward (e.g., to a floor). When the bed is in its upmost position, the space underneath may be occupied by a table. In order to make the transformation between upward and downward configurations effective, the height of the table may need to be adjusted, such that the table may change from a collapsed position when the bed is down to its raised position when the bed is up. FIG. 5 shows exemplary configurations of elements of vertically translating robotic furniture and architectural elements. The vertically translating robotic furniture and architectural elements may be positioned in a configuration 501*a* and a configuration 501*b*. In the configuration (i.e. table configuration) 501*a*, a movable element (e.g., bed) 502 may be positioned within a canopy 504. A table 508 may be configured in an up (i.e. raised) position when the vertically translating robotic furniture and architectural elements are configured with the table configuration 501*a*. In the configuration (i.e. bedroom configuration) 501*b*, the movable element (e.g., bed) 502 may be positioned adjacent and/or proximal to the table 508, where the table 508 is configured in a down (i.e. lowered) position.

Due to the design and application of the vertically translating robotic furniture and architectural elements, there are some requirements that complicate the development of a lifting mechanism configured to lift the table 508. From a design and user experience standpoint, the lifting mechanism may be required to be as hidden as possible. The vertically translating robotic furniture and architectural elements may be used in a residential environment (or any other suitable environment) where industrial looking mechanisms may not be acceptable. The lifting mechanism may be required to be aesthetically appealing, integrated, and as inconspicuous as possible. From a usability standpoint, the table 508 (and objects/items positioned on the table 508) may be required to be hidden below the movable element (e.g., bed) 502 in the bedroom configuration 501*b*, such that the table 508 must be able to collapse to occupy as little vertical space as possible. In some embodiments, the table 508 may be required lift to the typical working/dining height (e.g., around 30 inches) off of the floor. From a functionality standpoint, it may be desirable if a user is not required to remove the objects on the table 508 in order to operate (e.g., move) the system (e.g., change between the configurations 501*a* and 501*b*). In other words, the user can leave a laptop, books, or other similar object on the table, and the system would still be able to shift from one configuration to the next. Accordingly, the table 508 may be required to stay parallel to the ground, eliminating the possibility for hinged or rolled configurations of the table 508. For manual operation (e.g., in case of a power outage), it may be desirable for the user to be able to manually operate the lifting mechanism for the table 508 (e.g., without the aid of motors). Accordingly, the lifting mechanism may be required to be back-driveable without the need of special tools. In some cases, the loads expected to be on the table 508 may be variable and will depend on the daily usage of the user. The lifting mechanism may be required to operate (e.g., smoothly operate) with loads ranging from 0 lbs to approximately 40 lbs. The lifting mechanism may be required to comply with safety standards for motorized furniture. When the table 508 is extended, it may be required to be stable. The table 508 may be required to stay up and not drop (e.g., collapse) with a significant load is applied to the table 508 (e.g., when a person sits on the table). The table 508 may be required to feel sturdy and function like a normal legged table. This performance must be expected regardless of whether the lifting mechanism (e.g., motor) is powered. As an example, if there is a power outage, and the table 508 is loaded, it must remain in an upward position until the user decides to manually operate it. In some embodiments, a scissor lift may be used as a lifting mechanism for the table 508 to to meet each of the requirements described herein.

Figure 6:
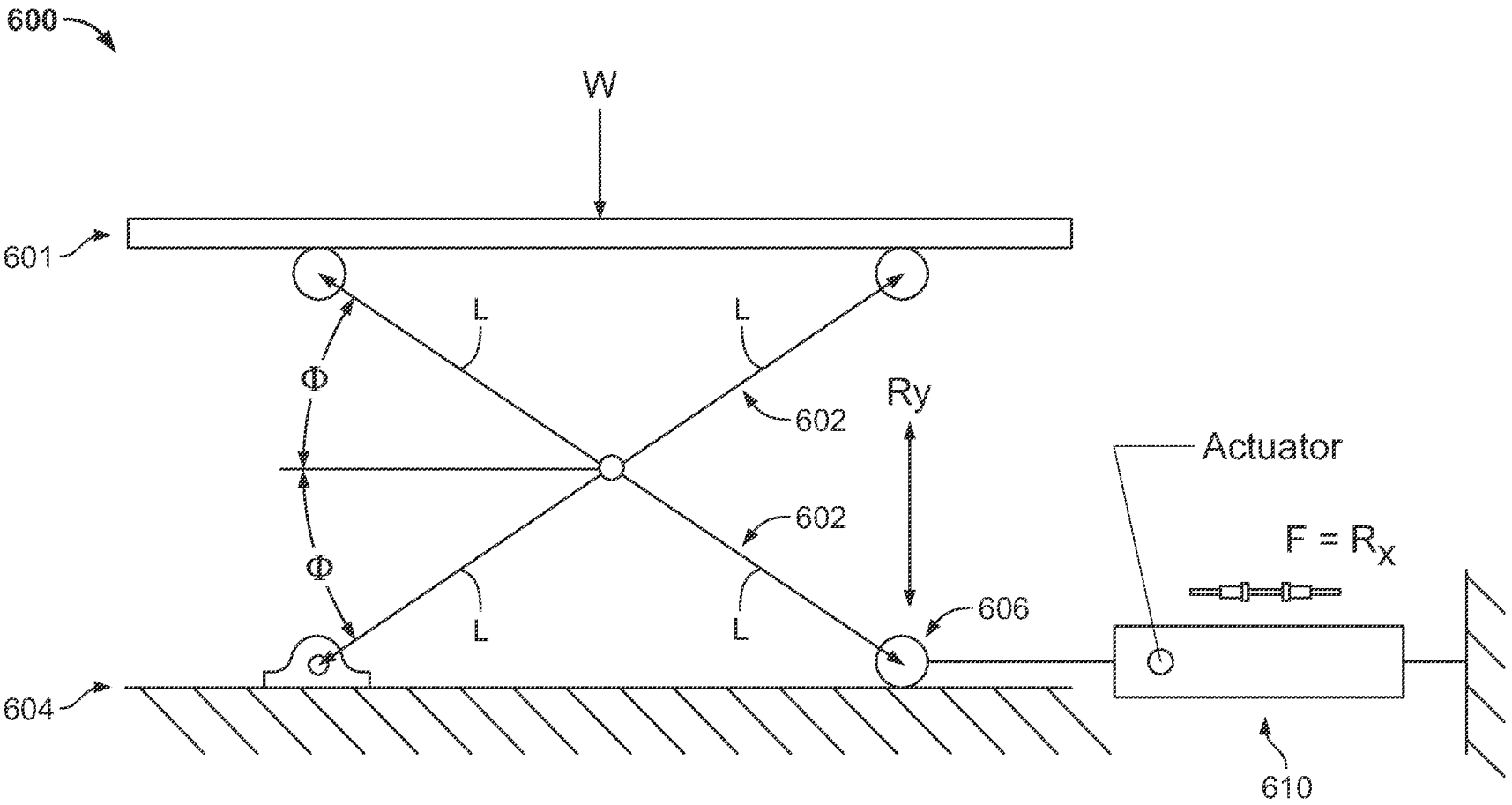
FIG. 6 shows an example of a lifting mechanism, according to various embodiments.

FIG. 6 shows an example of a lifting mechanism 600 for robotic furniture and architectural elements. As shown in FIG. 6, the lifting mechanism 600 may be a scissor lift that is configured to hold a lifting surface 601 (e.g., table 508) parallel to a surface 604 (e.g., the ground). The scissor lift can be identified by one or more "X" shaped sets of linkages (i.e. legs) 602. Extension of the scissor lift can be achieved by applying horizontal pressure to the outside of a set of supports 606 located at one end of the mechanism, elongating the crossing pattern in the vertical direction.

Figure 7:
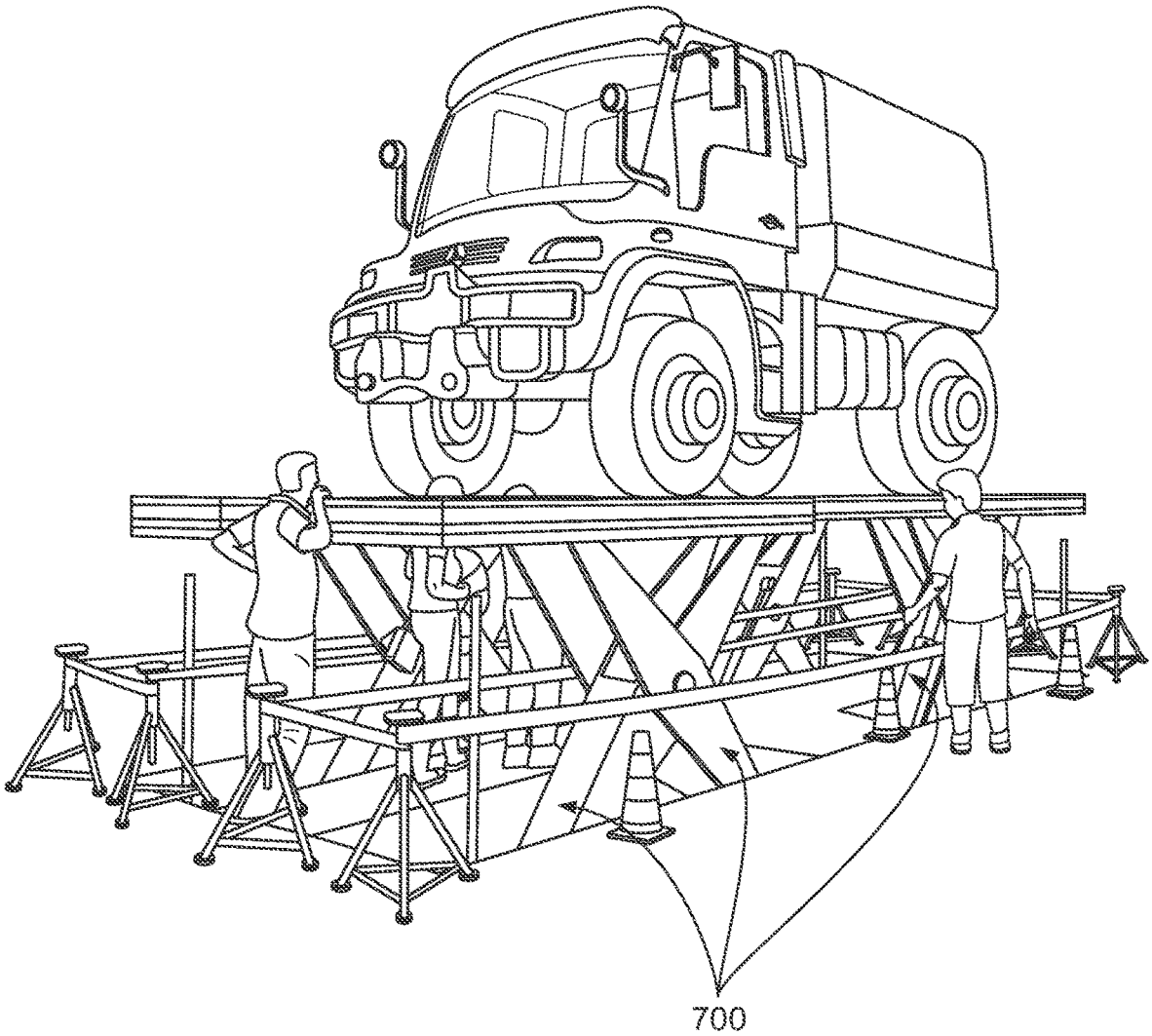
FIG. 7 shows an example of a scissor lifting mechanism for an industrial application, according to various embodiments.

Use of a scissor lift is common in devices such as lift tables. Some computer keyboards use scissor lifts as well, installing each key on a scissor support to ensure their smooth vertical movement. A pantograph mirror is another application of a scissor mechanism. Although lift tables conic in an array of configurations and can be built to suit various highly specialized industrial processes, typically lift tables are used to raise large, heavy loads through relatively small distances while having a very small collapsed height. Common applications are industrial in nature, and include pallet handling, vehicle loading, and work positioning. FIG. 7 shows an example of a scissor lifting mechanism 700 for an industrial application.

Although the mechanical principle to move a lifting surface 601 vertically is appropriate for the table 508 of the vertically translating robotic furniture and architectural elements, existing scissor lifts fail meet each of the requirements as described above. Accordingly, an actuator 610 may be designed around a modified, belt-driven, scissor lift mechanism used to raise and lower the lifting surface 601 (e.g., table 508). This scissor lift mechanism includes many advantages over alternative lifting mechanisms.

Figure 8A:
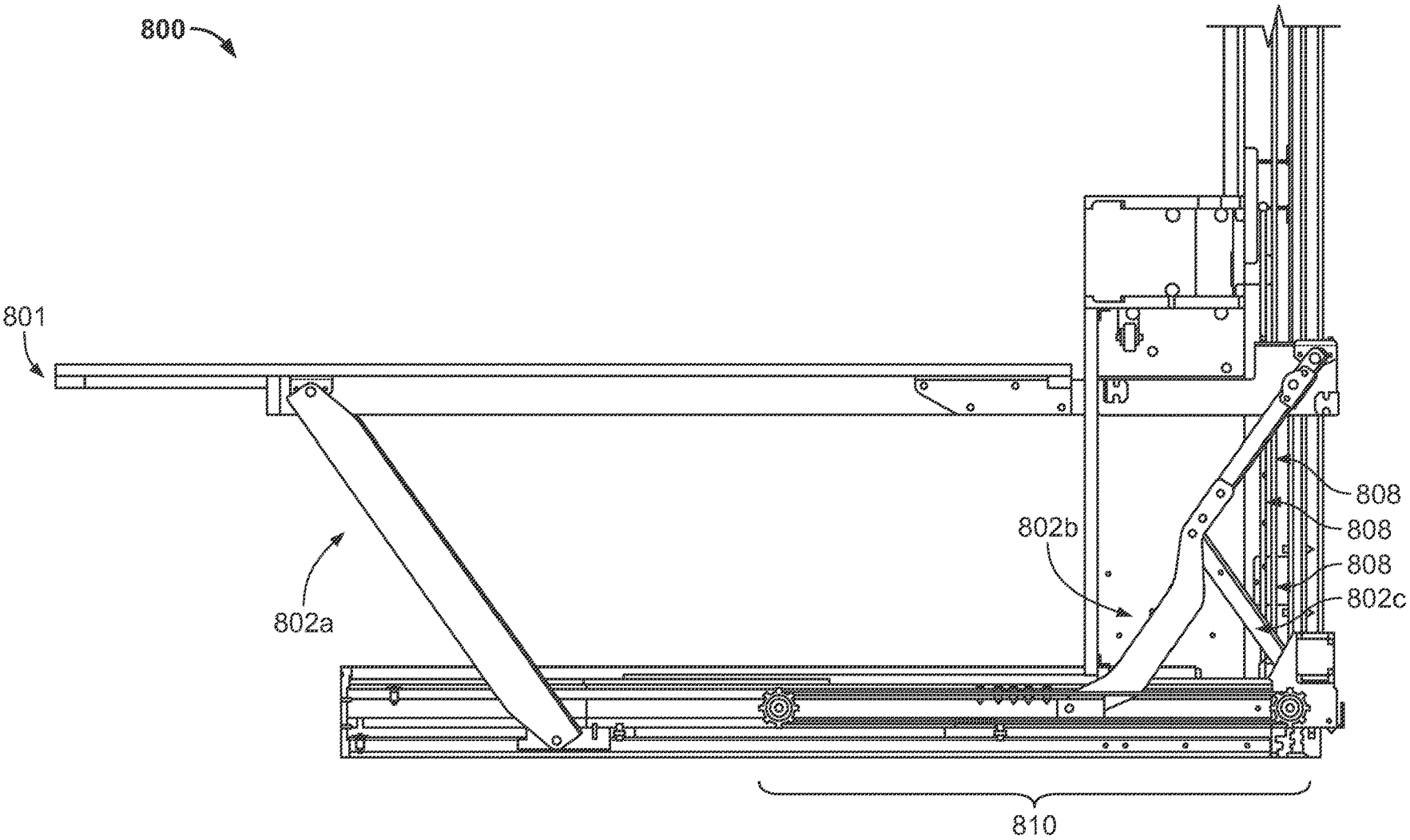
FIG. 8A shows an example of a lifting mechanism for robotic furniture and architectural elements, according to various embodiments.
Figure 8B:
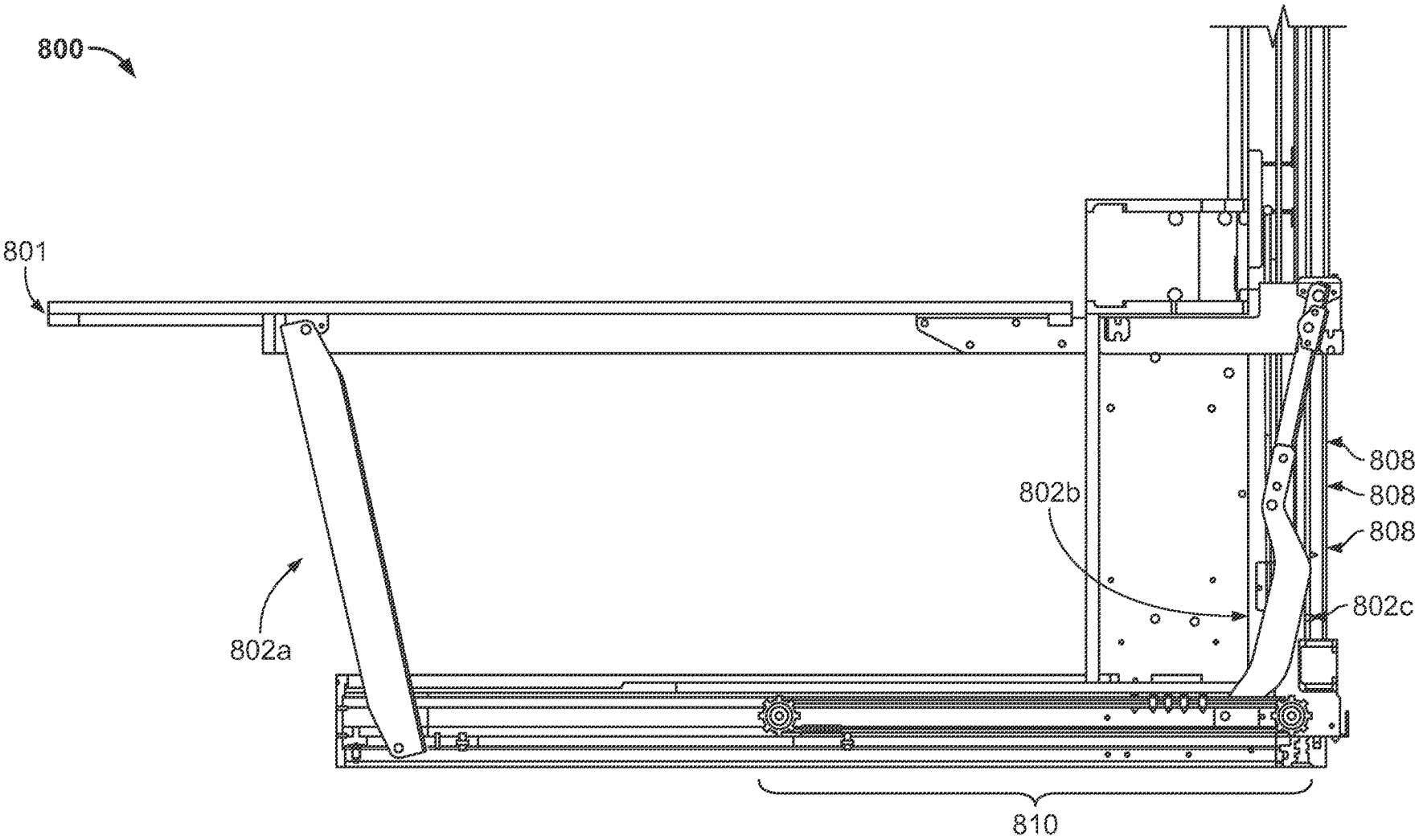
FIG. 8B shows an example of a lifting mechanism for robotic furniture and architectural elements, according to various embodiments.
Figure 8C:
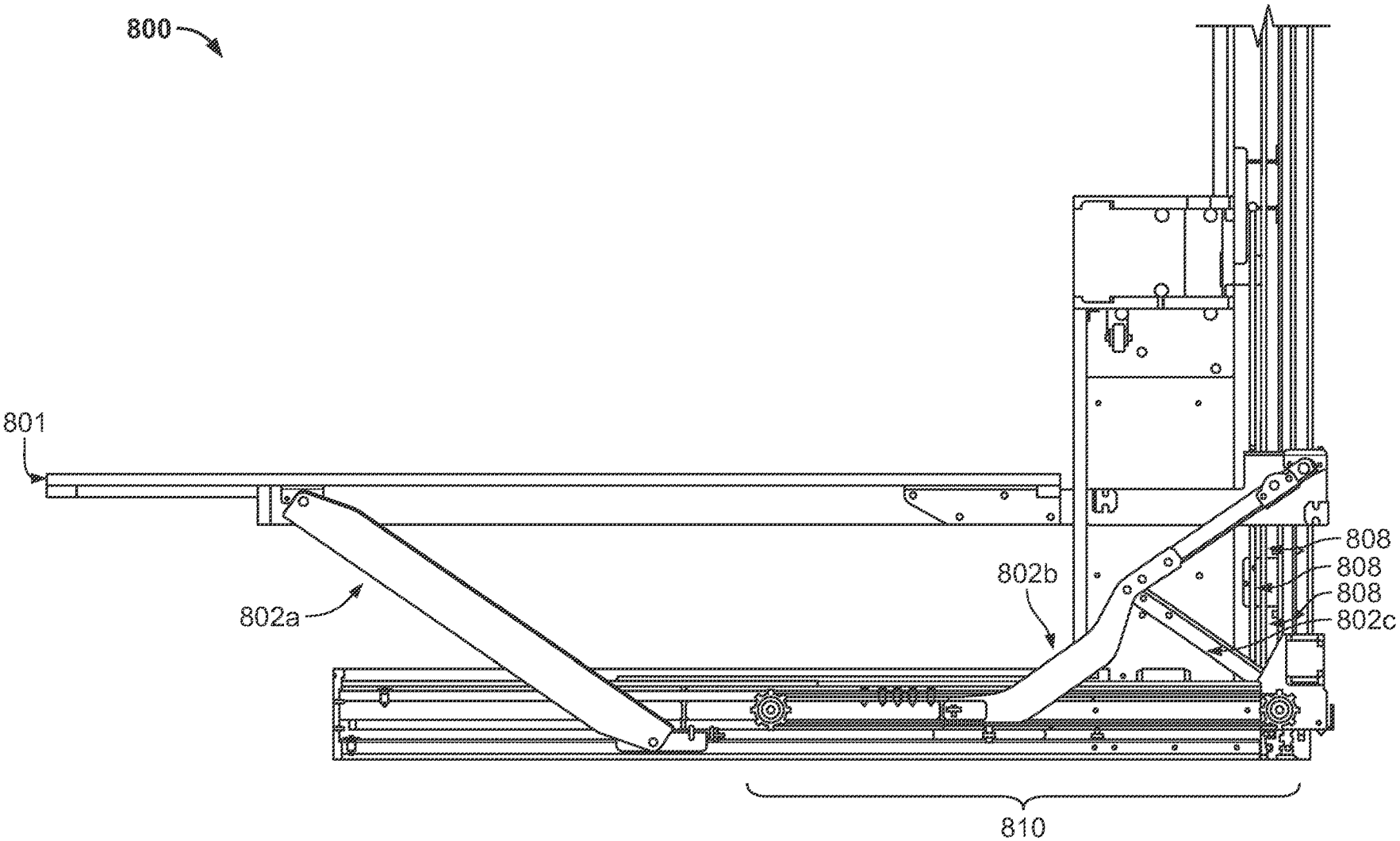
FIG. 8C shows an example of a lifting mechanism for robotic furniture and architectural elements, according to various embodiments.
Figure 8D:
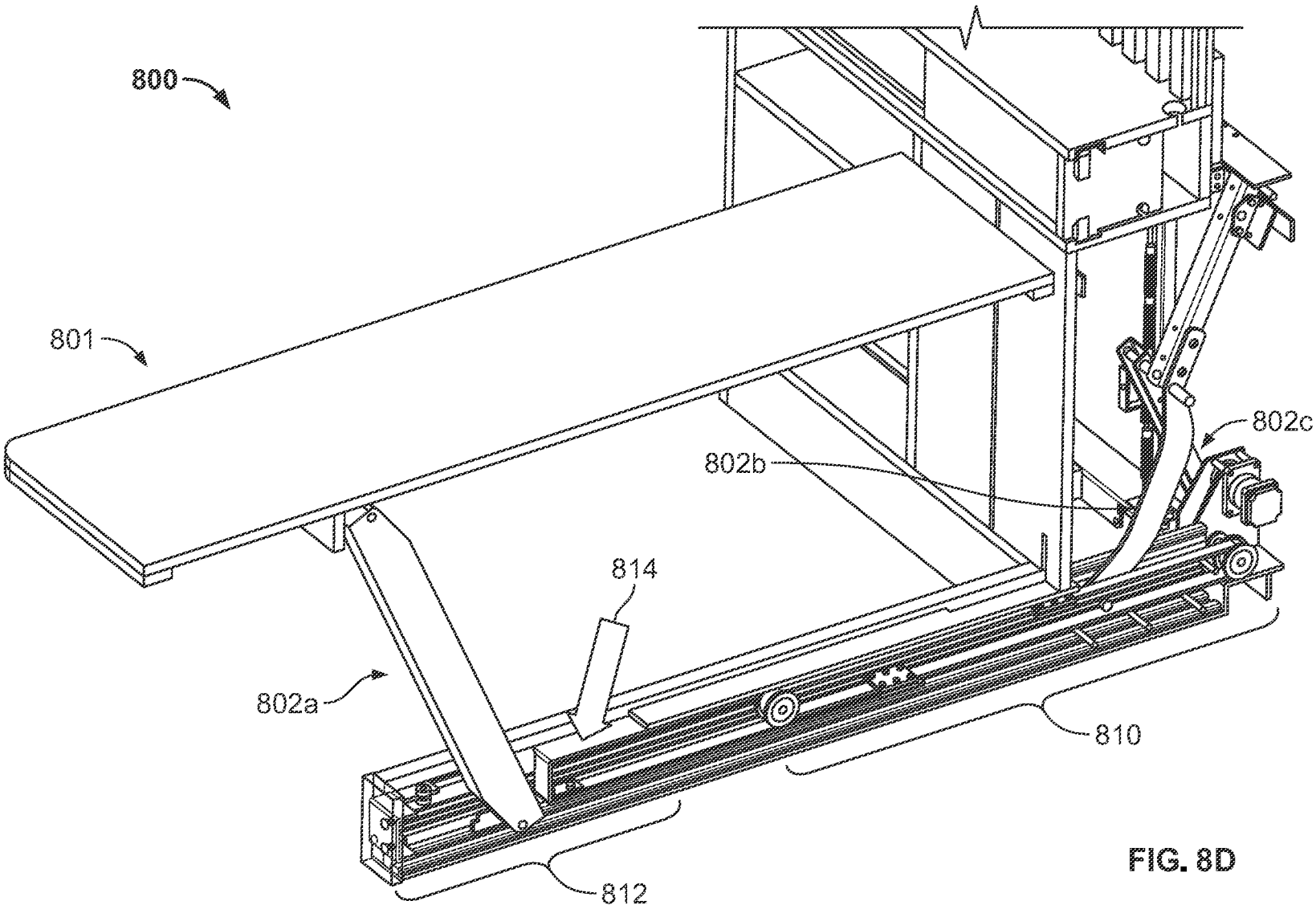
FIG. 8D shows an example of a lifting mechanism for robotic furniture and architectural elements, according to various embodiments.

FIGS. 8A-8D show examples of a lifting mechanism 800 for robotic furniture and architectural elements. FIG. 8A shows an example of a lifting mechanism 800 for robotic furniture and architectural elements with a table 801 in a partially raised, upright position. FIG. 8B shows an example of a lifting mechanism 800 for robotic furniture and architectural elements with a table 801 in a raised, upright position. The lifting mechanism 800 may be a modified scissor lift mechanism. FIG. 8C shows an example of a lifting mechanism 800 for robotic furniture and architectural elements with a table 801 in a partially lowered, downward position. FIG. 8D shows an example of a lifting mechanism 800 for robotic furniture and architectural elements with a table 801 in a partially raised, upright position. The lifting mechanism 800 may include one or more linkages (i.e. legs) 802. The linkages 802 of the lifting mechanism 800 may be configured to suit the aesthetics of the vertically translating robotic furniture and architectural elements described herein with respect to FIG. 5. In the lifting mechanism 800, the two halves of the "X" as described herein with respect to FIG. 6 are separated horizontally so that a linkage (e.g., exposed linkage) 802*a* is unencumbered. A linkage 802*b* (e.g., the other half of the "X") is almost entirely hidden from the view of the user by architectural elements of the robotic furniture and is attached to a linkage (e.g., completely hidden half linkage) 802*c* that maintains the parallelism between a lifting surface (i.e. table) 801 and the ground. One or more of the linkages 802 may be coupled to a belt drive actuator 810.

The lifting mechanism 800 may enable a relatively large stroke with a relatively small collapsed height. For the lifting mechanism 800 to achieve a stroke greater than a collapsed height of the lifting surface 801, the lifting, mechanism 800 may require a more complex and costly actuator with multiple stages.

Figure 9:
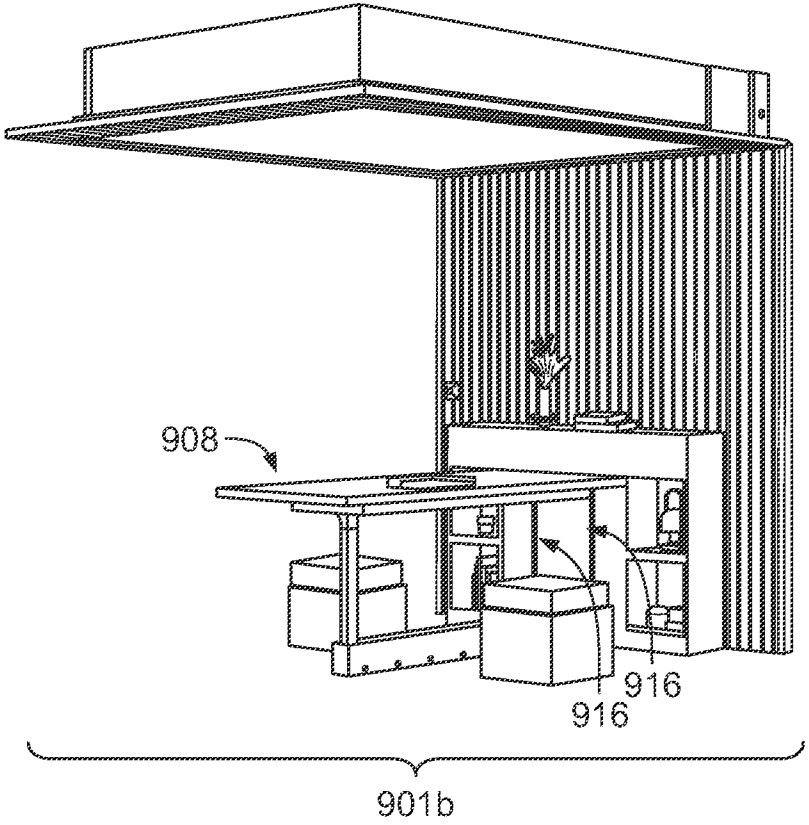
FIG. 9 shows exemplary configurations of elements of vertically translating robotic furniture and architectural elements, according to various embodiments.
Figure 9:
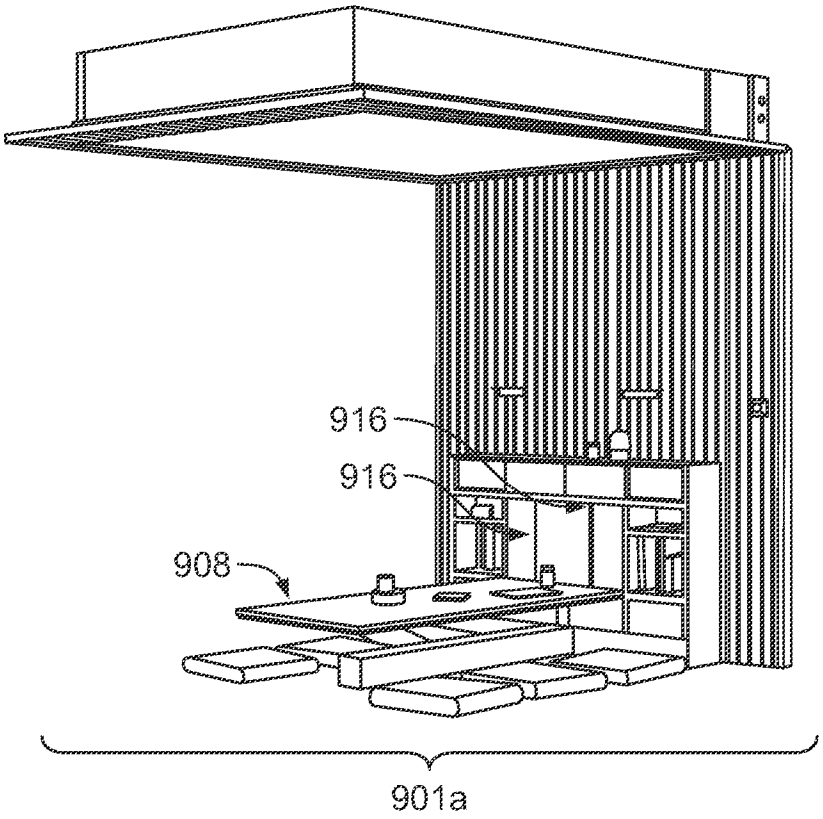

FIG. 9 shows exemplary configurations of elements of vertically translating robotic furniture and architectural elements. The vertically translating, robotic furniture and architectural elements may be positioned in a configuration 901*a* and a configuration 901*b*. In the configuration (i.e. lowered table configuration) 901*a*, a lifting surface (i.e. table) 908 may be configured in a down (i.e. lowered) position. In the configuration (i.e. raised table configuration) 901*b*, the table 908 may be configured in an up (i.e. raised) position. The lifting mechanism 800 as described herein with respect to FIGS. 8A-8D may be used as a part of the vertically translating robotic furniture and architectural elements to configure the position of the table 908.

With respect to FIGS. 8A 8D, the table 801 may move from a typical table height of approximately 30 inches (e.g., configuration 901*a* shown in FIG. 9) to a minimum lowered height of approximately 10 inches (e.g., configuration 901*b* shown in FIG. 9). The height of 10 inches may allow for the table 801 to have 6 inches of clearance below a moveable element (e.g., movable element 502 in configuration 501*b* as shown in FIG. 5), eliminating the user's need to completely remove objects from the table 801 before lowering a moveable element (e.g., bed) of the vertically translating robotic furniture and architectural elements. At a 10 inch height, the table 801 can be positioned at an adequate height for users who wish to work or dine seated on the floor. The lifting mechanism 800 may be configured to position the table 801 at any suitable height.

As shown in FIGS. 8A-8D, the lifting mechanism 800 may be powered by a belt drive actuator 810 (or any other suitable drive mechanism). The belt drive actuator 810 may be a single belt drive, where two carriages drive the ends of the linkages 802*a* and 802*b* in opposite directions to raise or lower the table 801. The design of the lifting mechanism 800 and the belt drive 810 may enable a lower motor gearbox ratio than would be required for a ball screw or lead screw. The design of the linkages 802 and the relatively low gearbox ratio may allow the user to back-drive the system manually, allowing the table 801 to be manually raised or lowered (e.g., during a loss of power).

At the top of the stroke (e.g., where the table 801 is raised) provided by the belt drive actuator 810, the linkages 802 may be approximately vertical. The approximately vertical positioning of the linkages 802 may provide a mechanical disadvantage against a simple downward force back driving the lifting mechanism 800. Thus, accidentally back-driving the table 801 with a downward force (e.g., as a result of a person's full weight on the table) may be designed to be not possible. To manually back-drive the table 801, the user may be required to push horizontally at the bottom of the exposed linkage 802*a* where there is a naturally large mechanical advantage.

To accommodate the non-linear nature of the actuator load on the belt drive actuator 810, the lifting mechanism 800 may include a vertical spring assist 808, which allows for the reduction of the maximum torque required by a motor of the belt drive actuator 810 at any given moment. The spring assist 808 may enable the use of a smaller motor, which can minimize the torque applied by the motor and can avoid excessive pressure being placed on any potential obstruction.

At the bottom of the stroke (e.g., where the table is lowered) provided by the belt drive actuator 810, where the belt drive actuator 810 has the lowest mechanical advantage because the leg is almost horizontal, the springs of the spring assist 808 can be fully compressed and counteract the weight of the table/desk. This can dramatically reduce the load on the belt drive actuator 810 (and the load on the associated motor).

Figure 10:
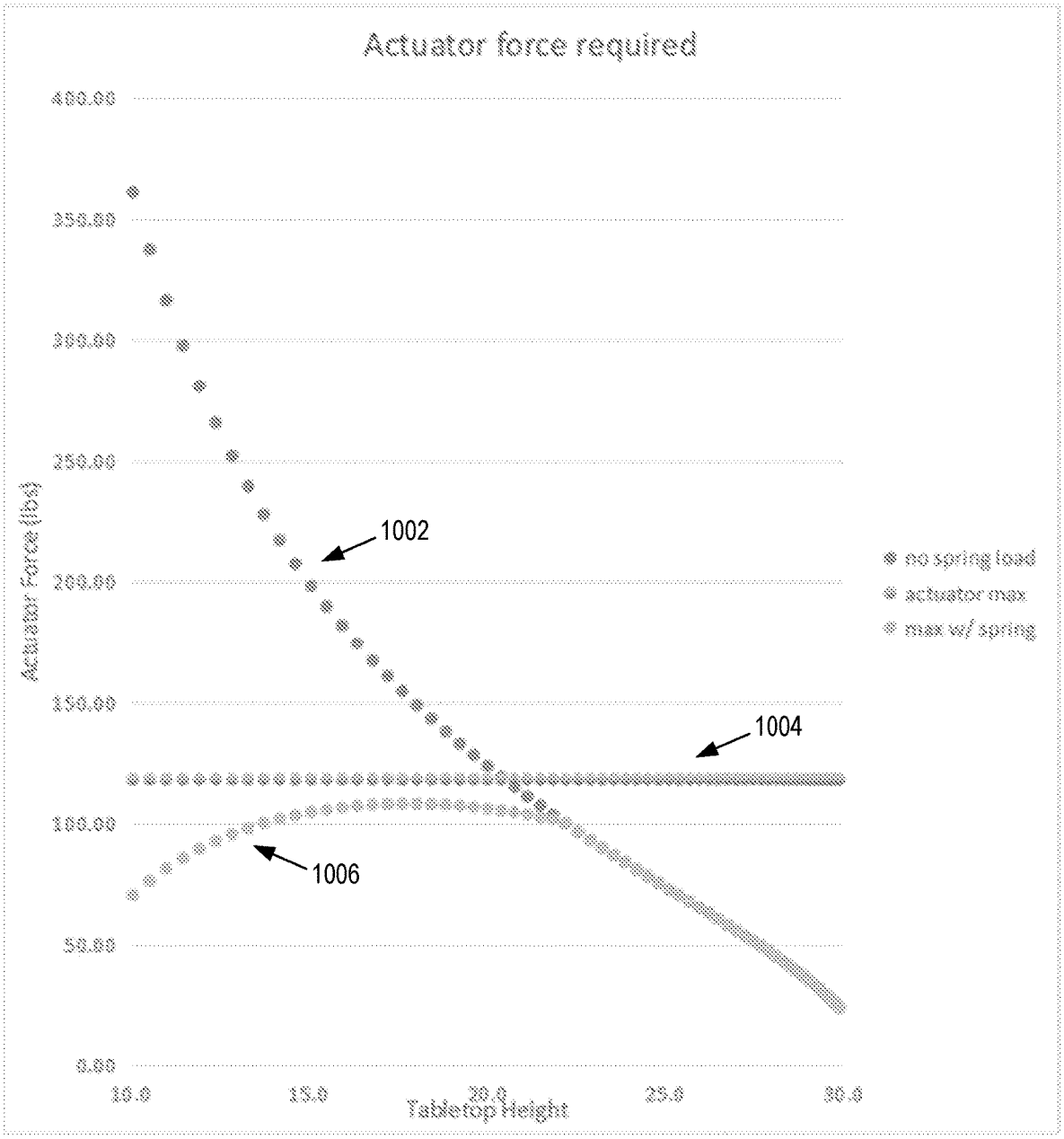
FIG. 10 shows an example of a plot of actuator force for controlling movement of an element of robotic furniture and architectural elements relative to a height of the element of the robotic furniture and architectural elements, according to various embodiments.

As the table 801 starts moving upwards (e.g., to the configuration 901*b* as shown in FIG. 9), the angle between the linkage 802*a* and the table 801 becomes bigger and the mechanical advantage load requirement is reduced. Tension is removed from the springs of the spring assist 808 as they elongate and they gradually apply less upwards force, leaving the motor to act as the main driving/actuating force on the linkages 802 the coupled table 801. During the upper middle-half of the travel length (e.g., between 20-30 inches in height), the lifting mechanism 800 provides a large mechanical advantage and the springs of the spring assist 808 are totally uncompressed, FIG. 10 shows an example of a plot 1000 of actuator (e.g. belt drive actuator 810) force for controlling movement of an element (e.g., table 801) of robotic furniture and architectural elements relative to a height of the element of the robotic furniture and architectural elements. The plot 1000 below shows the impact of springs of the spring assist 808 in relation to the maximum load experienced by a motor of the belt drive actuator 810 as the height of the table 801 is raised. Line 1002 shows the force required to raise the table 810 without the use of the spring assist 808. As shown in FIG. 10, without the spring assist 808, the motor of the belt drive actuator 810 may be required to exert more than 350 lbs of force in the early stages of travel (e.g., between 10-20 inches in height) in order to operate. Line 1006 shows the force required to raise the table 810 with the use of the spring assist 808. As shown in FIG. 10, with the aid of the spring assist 808, the motor of the belt drive actuator 810 may be required to exert a maximum of approximately 100 lbs. Line 1004 shows the maximum force that can be exerted by the belt drive actuator 810. By using a spring assist 808 to assist this movement, the maximum force of the motor of the belt drive actuator 810 can be capped at approximately 120 lbs, which avoids excessive pressure being placed on any potential obstruction. In this way, the springs of the spring assist

808 are used in places where the mechanical advantage of the modified scissor mechanism is the weakest (e.g., as defined by the areas where the angle between linkage 802*a* and horizontal surface is the smallest), enabling the lifting mechanism 800 to avoid oversizing the motor of the belt drive actuator 810.

Conventional scissor lifts may include one or more potential pinch points which could pose a safely hazard. A pinch point may be a point in between a moving and a stationary part of a machine where an individual's body part (or any other suitable object) may become caught, potentially leading to injury and/or damage. The modified scissor lift configuration of the lifting mechanism 800 avoids pinch points in various ways. By separating the linkage 802*a* and the linkage 802*b*, the center pinch points typically found in a scissor lift are eliminated. As previously noted, the linkage (e.g., rear leg) 802*b* can be positioned almost entirely behind the architectural elements (e.g., chest furniture), such that pinch points associated with the linkage 802*b* do not pose any danger to the user. The specific curvature of the linkage 802*b* is designed such that when the linkage 802*b* does protrude outside of the architectural elements (e.g., chest furniture) mid-way through the stroke, the back of the linkage 802*b* may not accessed. Any objects that are on the slots where the linkages 802*b* exit the architectural elements merely be pushed away. Slots 916 where linkages may exit the architectural element of the vertically translating robotic furniture are shown in FIG. 9. As the table 801 changes position (e.g., rises or lowers), the linkage 802*a* (e.g., front leg) travels or pivots through an opening in a main extrusion as shown in FIG. SC. To avoid pinch points and the potential for dropped materials to get into the mechanism through this opening, a sheath 814 moves with the linkage 802*a* (e.g., front leg) to cover the slot as the leg moves through its full range of motion.

Weight Balancing Calibration Feature

In applications where moving elements (e.g., moving elements 202 and 502) transport heavy loads vertically, counterweighting is often used to oppose and balance the gravitational force of the load to be moved and reduce the torque and force requirements of the actuating mechanisms (e.g., such as motors, gears, pulleys, etc). Counterweighting can involve coupling a load comparable to the load to be moved to a first end of the actuating mechanism, such as to a rope/wire end of a pulley opposite the load to be moved. When the load to be moved is lifted, the counterweight descends, and vice versa. With counterweighting, the actuating mechanism can be simpler and less costly; but, since the torque and force outputs are limited, the counterweighting must balance the system to within the limits of the actuating mechanism.

There are multiple ways to balance a counterweighing system, many of which can be a manual, iterative process and very dependent on the particular system and application.

Counterweighting in applications in which the load to be moved is consistent (e.g., always the same) is the most straightforward; in this case, the counterweight load can be calculated, fit to the system, and is the same in every operation.

In applications where the load to be moved can vary, the counterweight may need to be frequently adjusted (particularly if the load differentials fall outside the range that can be handled by the actuating mechanism). This can be straightforward when there is a limited set of loads in the application and counterweighting for each is defined and easy to adjust.

However, there are some applications in which the counterweighting adjustment process can be tedious, laborious, or prone to errors and inaccuracies, especially when the process is iterative and manual and when weight measurement tools cannot be used or are unavailable. For example, when the load to be moved cannot be measured by a weight measuring tool such as a scale (for example, because it is too costly to incorporate one into the movable element system), a user may be required to adjust the loading on the counterweight until a certain condition indicates balance, such as the load and the counterweight remaining static while above the floor, or the actuating mechanism being able to move the load both directions.

In these cases, adjustment can be an iterative process in which a user adds or removes weights to/from the counterweight in increments, stopping to see how the load to be moved or movable element responds each time. Moreover, the final loading configuration may not necessarily be balanced, even if the actuating mechanism can operate, and depending on the application this may cause instability or otherwise not be desirable.

Manufacturing defects or tolerances can mean that movable systems of the same type can require different levels of counterweight, even when the load to be moved is identical. In these situations, an iterative manual process of balancing would be necessary, even when weight measuring tools are available.

In the case of the movable element (e.g., bed) of the vertically translating robotic furniture and architectural elements described herein, a counterweighting system can be used to oppose the weight of the movable element (e.g., a bed including a frame and a mattress), which can allow an inexpensive stepper motor and pulley system to be used as the actuating mechanism. Because the movable element (e.g., bed frame) can accommodate different types of furniture elements (e.g., mattresses), the total weight of the movable element can be different from unit to unit based on the weight of the furniture elements added to the movable element. The weight of added furniture element(s) can be determined from the specifications and those installing the movable element (e.g., bed) of the robotic furniture can determine (e.g., calculate) the amount of weight needed in the counterweight. As such, the counterweight balance can be confirmed by ensuring that the movable element (e.g., bed) remains static when the system is unpowered, and by ensuring that the actuating mechanism can actuate the movable element (e.g., bed) up and down.

In some cases, there can be manufacturing defects or tolerances in a furniture element (e.g., mattress in the movable element system, and in the weights used in the counterweight, such that the system is within the operating bounds of the actuating mechanism, but is unbalanced. This is especially undesirable in this application, because a user of the movable element (e.g., bed) who subsequently loads the movable element with additional weight (e.g., bedding such as pillows, blankets, and comforters) could cause the counterweight to become unbalanced beyond the operating bounds of the actuating mechanism. Therefore, a solution is needed to allow for the counterweighting process to achieve an accurate balance.

In some embodiments, the counterweighting may include one or more requirements. First, for cost and ease, the solution may use an included load measuring feature corresponding to a stepper motor driver of the vertically translating robotic furniture and architectural elements. An external weight measuring device may not be easily used during installation of the movable element and adding a weight measuring device can add cost and design complexity. Second, the solution can be used for fine-grained balancing. In other words, once the system is installed and balanced such that there is no unpowered movement of the loads, and the actuating mechanism works properly, the solution can be used to achieve more accurate balance. Third, the solution may be configured to be accurate to within the smallest individual weight that can be added or removed to/from the counterweight in the application, so long as the application sensing allows for that level of differentiation. This enables for a simplified, accurate balancing process. Fourth, the solution can include a simple mechanism/interface for feedback and can be multi-modal, such as using visual and auditory feedback. Fifth, the solution can enable an expedited (e.g., as fast as possible) iterative process, such as by only requiring one cycle of motion in each direction by the actuating mechanism/motor. Sixth, once calibrated as part of the initial set-up, the solution should be automatic and intuitive, and require no user training or technical skill.

The load measurement can be done as described in U.S. Patent Publication No. 20200256109, incorporated herein by reference in its entirety.

In essence, the weight balance estimation should be derived from the analysis and comparison of loading, or torque demands, on the motor(s) moving in each direction in the application.

Once the counterweighting system is sufficiently balanced, the automation assisting process can be executed. The processor and software, referred to as the controller, may be configured to sample the load measuring variable as fast as the application allows the sampling and reading of the load values, including filtering if needed. The controller may be configured to initiate motion (e.g., based on user command) from a predefined position in a predefined direction for a predefined length of travel at a predefined speed, all defined per the application. Based on initiating motion as described above, the controller may determine a representative loading of the motor. To determine the representative loading, the controller may determine and store all the load values sampled, a representative sample of them, or a processed variable(s) indicative of the load on the motor that is updated with each reading, such as a cumulative average. Any technique for obtaining a representative loading of the motor across the motion in the direction can be used as long as it is found effective in the application.

Upon reaching the end of travel in the initial direction successfully, the controller is to next initiate motion in the opposite direction back towards the starting position at the same speed. The controller may record and process the load measurements as in the previous direction. Once the motion is successfully completed, the controller may compare the representative loading output in both directions. The controller may determine a different between the loading output in each direction to determine whether the system is balanced. If the loading outputs (e.g., representative loadings) for each direction of motion are within a certain threshold of each other, the controller may determine the system (e.g., movable element of vertically translating robotic furniture) to be balanced. The controller may communicate positive feedback (e.g., to a user via tactile, auditory, or visual communications) that is indicative of the system being balanced. If the loading outputs (e.g., representative loadings) for each direction of motion are not within a certain threshold, the controller may determine the system to be unbalanced. The controller may communicate negative feedback (e.g., to a user via tactile, auditory, or visual communications) and feedback indicating whether weight should be added to or removed from the counterweight, based on which direction of motion had a higher representative loading, in some cases, the feedback may include an estimate of how much weight, or how many weights, to add or subtract from the counterweight. Once the user adjusts the counterweight, they can command the controller (e.g., via providing an input) to repeat the process. The calibration process for weight balance estimation may be complete when the controller determines the loading outputs (e.g., representative loadings) for each direction of motion to be within a certain threshold of each other. Accordingly, the weight calibration process may be complete when the controller outputs positive feedback indicating that balance is obtained.

Weight balance estimation may be more accurate when more load measurements are sampled and processed for use in the comparison described above. Accordingly, the controller may only provide the feedback indicating whether the system is balanced if there is a minimum number of samples collected for each direction of motion (e.g., raising or lowering the movable element). In some cases, the length of travel may include a threshold percentage (e.g., high percentage, if not all) of the physically possible range of travel of the movable element in the application. Using a high percentage of the physical possible range of travel as the length of travel for sampling the load measurement may maximizes the number of samples collected and may capture the most complete picture of loading on the motor in each direction of motion.

In this embodiment, the setup to the weight balancing calibration starts with the following. The counterweight may be loaded until the load to be moved (e.g., the movable element) is stationary (e.g., moves neither up nor down). In the example of the movable element (e.g., bed) of vertically translating robotic furniture and architectural elements, a furniture element (e.g., mattress) may be loaded onto the movable element (e.g., bed frame), and the prescribed calculated weight may be added to the counterweight. The movable element (e.g., bed) may be tested to confirm that it remains stationary (e.g., moves neither up nor down) when unpowered. If the movable element does not remain stationary, the counterweight loading may be adjusted until the movable element remains static.

The travel length of the moveable element may be configured and programmed to be any suitable length. In one embodiment of the vertically translating robotic furniture and architectural elements, the user may access a "travel limit programming mode" to configure the travel length of the movable element for weight balancing calibration. The user may configure the lower limit of travel for the movable element (e.g., bed) to be where the movable element's architectural elements (e.g., bed legs) touch the floor (e.g., as shown in configuration 501*b* in FIG. 5) and the upper limit to be where the movable element (e.g., bed) aligns with the canopy (e.g., as shown in configuration 501*a* in FIG. 5). Configuring the lower and upper limits of travel may validate that the actuating mechanism can raise and lower the load (e.g., movable element).

The actuating mechanism may move the moveable element to an initial position. The movable element may be moved to an initial position based on the configuration of the lower and upper limits of travel. In the vertically translating robotic furniture and architectural elements, the initial position may be a lower limit where the movable element is lowered as shown in configuration 501*b* in FIG. 5. The user may commands the automatic calibration process to execute. In one embodiment of the vertically translating robotic furniture and architectural elements, the user may provide an input to execute the automatic calibration process via a special interface button combination.

In one embodiment, based on receiving a command to execute the automatic calibration process, the actuating mechanism may moves the load (e.g., movable element) to the end of the travel length al the application speed. In the vertically translating robotic furniture and architectural elements, the movable element (e.g., bed) may be moved to the configured upper limit (e.g., as shown in configuration 501*a* in FIG. 5). While moving at the constant application speed, the controller may record one or more load measurements. In one embodiment of vertically translating robotic furniture and architectural elements, the controller may record the one or more load measurements using two variables, where the two variables are used to determine a cumulative average load measurement. Two variable may be used to determine the cumulative average load measurement for ease, simplicity, and due to the limited nature of the application's controller memory and processing power. As described herein, any other suitable technique for capturing and storing the load measurement information may be used. The cumulative average may be determined (e.g., computed) as follows. A first variable may represent the cumulative average load measurement and a second variable may represent the number of samples of load measurements used to determine the cumulative average. Each time a load measurement is obtained (i.e. sampled), the controller may multiply the number of samples computed by the cumulative average, which may be a "total load measurement". The controller may add the current (i.e. present) load measurement to the total load measurement. The controller may increment the "number of samples" variable (e.g., by 1 to account for the current load measurement). The controller may divide the total load measurement by the incremented number of samples to determine a new cumulative average load measurement, where the cumulative average load measurement includes the current load measurement. The cumulative average load measurement may be stored in the cumulative average (e.g., first) variable as described herein. This cumulative average variable may be stored by the controller when the moveable element begins to decelerate to a stop (e.g., at the upper limit). After decelerating to a stop, the controller may starts motion in the other direction (e.g., down to the floor at the lower limit). The controller may uses two other variables (e.g., third and fourth variables) to process the cumulative average load measurement in that direction.

When the moveable element reaches the end of travel in the second direction, the controller may compare the two cumulative average load measurement variables. If the variables are within a certain application specific threshold of each other, the controller may determine the system to be balanced and the controller may provide positive feedback (e.g., to a user). In one embodiment of the vertically translating robotic furniture and architectural elements, the controller may cause a speaker included in the furniture's interface to ring three ascending ringtones. If the variables are not within a certain application specific threshold of each other, the controller may determine the system to be unbalanced and may provide negative feedback. In the one embodiment of the vertically translating robotic furniture and architectural elements, the controller may cause the speaker to ring three constant ringtones. In some cases, the controller may cause the furniture to provide visual feedback (e.g., via lighting or a display device included with and/or otherwise coupled to the furniture). In one embodiment of the vertically translating robotic furniture and architectural elements, the furniture may include a first pressable icon with an arrow pointing up and a second pressable icon with an arrow pointing down. The icons may include adjustable backlighting and may be used to command the movable element (e.g., bed) to move up and down (e.g., via press and hold operation). For weight balancing calibration, the icons can indicate (e.g., to the user) what should be done to adjust the counterweight (if the counterweight is unbalanced). If there was more load on the actuator (e.g., motor) when moving up compared to moving down, this indicates more weight is needed in the counterweight (or less weight on the load), and the controller can flash the up arrow on and off. If there was more load on the motor moving down than moving up, the controller may determine that less weight is needed in the counterweight (or more weight on load). The controller may flash the down arrow on and off based on determining that less weight is needed in the counterweight. Any intuitive or documented feedback from an application-specific interface can be used to indicate that the system is unbalanced and whether to add or remove weight from the counterweight (or load). Based on the resolution of the load sensing and increments of weight on the counterweight and interface capabilities, additional feedback may indicate how much weight to add or remove to the counterweight (rather than indicating to adjust an individual unit of weight).

Based on adjusting the weight on the counterweight (or load) accordingly, the weight balancing calibration process can be repeated via a command to the controller. The user can stop the weight balancing process once the controller indicates a balanced system.

Operating Apparatus

Figure 11:
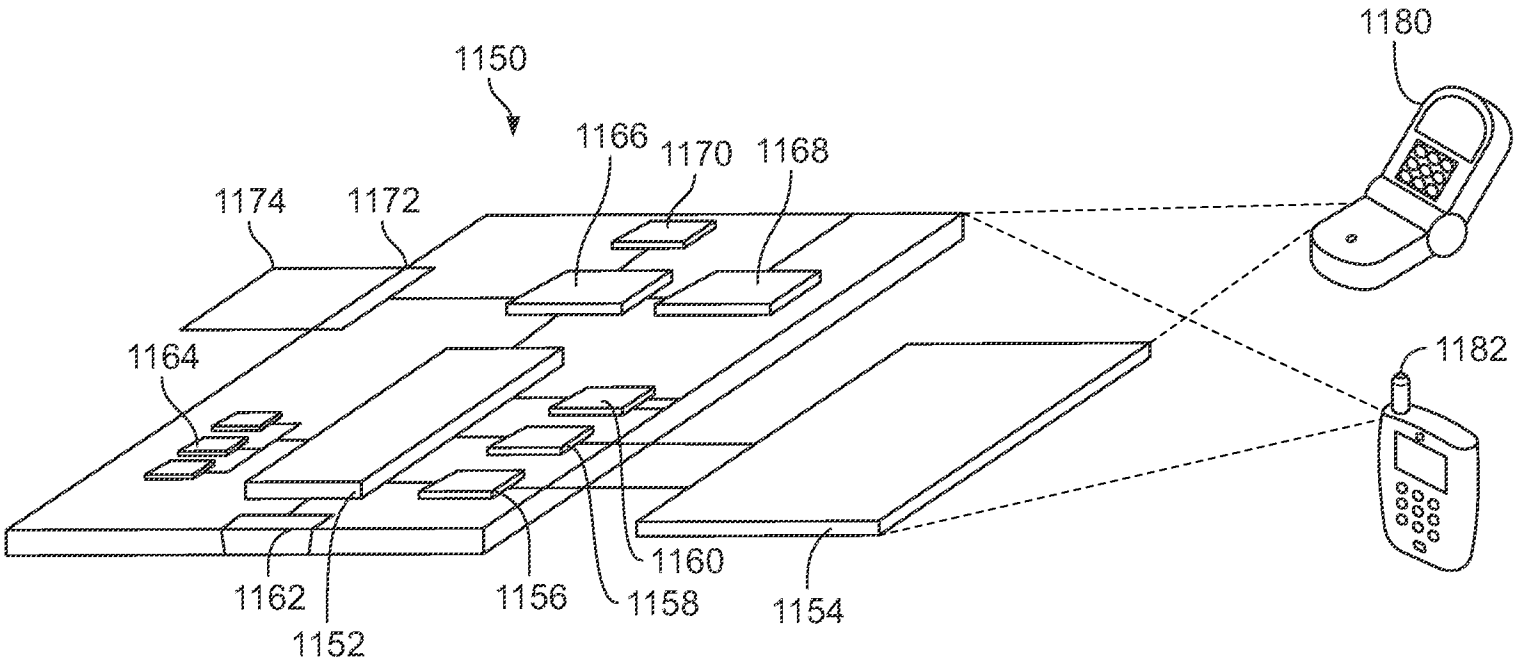
FIG. 11 shows an example of a generic computing device, which may be used with the techniques described in this disclosure, according to various embodiments.
Figure 12:
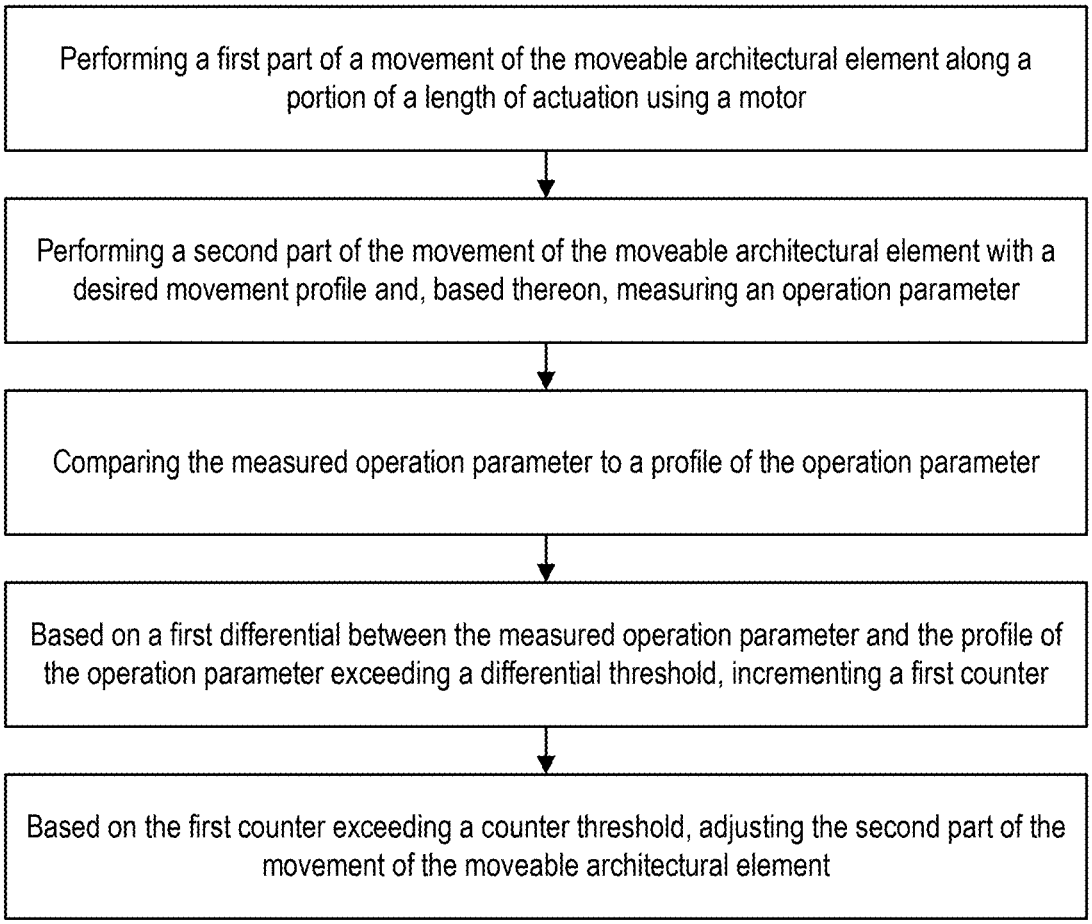
FIG. 12 shows an exemplary flowchart of a method of operating a moveable architectural element, according to various embodiments.

FIG. 11 shows an example of a generic computing device 1150, which may be used with the techniques described in this disclosure. Computing device 1150 includes a processor 1152, memory 1164, an input/output device such as a display 1154, a communication interface 1166, and a transceiver 1168, among other components. The device 1150 may also be provided with a storage device, such as a microdrive or other device, to provide additional storage. Each of the components 1150, 1152, 1164, 1154, 1166, and 1168, are interconnected using various buses, and several of the components may be mounted on a common motherboard or in other manners as appropriate.

The processor 1152 can execute instructions within the computing device 1150, including instructions stored in the memory 1164. The processor may be implemented as a chipset of chips that include separate and multiple analog and digital processors. The processor may provide, for example, for coordination of the other components of the device 1150, such as control of user interfaces, applications run by device 1150, and wireless communication by device 1150.

Processor 1152 may communicate with a user through control interface 1158 and display interface 1156 coupled to a display 1154. The display 1154 may be, for example, a TFT LCD (Thin-Film-Transistor Liquid Crystal Display) or an OLED (Organic Light Emitting Diode) display, or other appropriate display technology. The display interface 1156 may comprise appropriate circuitry for driving the display 1154 to present graphical and other information to a user. The control interface 1158 may receive commands from a user and convert them for submission to the processor 1152. In addition, an external interface 1162 may be provided in communication with processor 1152, so as to enable near area communication of device 1150 with other devices. External interface 1162 may provide, for example, for wired communication in some implementations, or for wireless communication in other implementations, and multiple interfaces may also be used.

The memory 1164 stores information within the computing, device 1150. The memory 1164 can be implemented as one or more of a computer-readable medium or media, a volatile memory unit or units, or a non-volatile memory unit or units. Expansion memory 1174 may also be provided and connected to device 1150 through expansion interface 1172, which may include, for example, a SIMM (Single In Line Memory Module) card interface. Such expansion memory 1174 may provide extra storage space for device 1150, or may also store applications or other information for device 1150. Specifically, expansion memory 1174 may include instructions to carry out or supplement the processes described above, and may include secure information also. Thus, for example, expansion memory 1174 may be provided as a security module for device 1150, and may be programmed with instructions that permit secure use of device 1150. In addition, secure applications may be provided via the SIMM cards, along with additional information, such as placing identifying information on the SIMM card in a non-hackable manner.

The memory may include, for example, flash memory and/or NVRAM memory, as discussed below. In one implementation, a computer program product is tangibly embodied in an information carrier. The computer program product contains instructions that, when executed, perform one or more methods, such as those described above. The information carrier is a computer- or machine-readable medium, such as the memory 1164, expansion memory 1174, memory on processor 1152, or a propagated signal that may be received, for example, over transceiver 1168 or external interface 1162.

Device 1150 may communicate wirelessly through communication interface 1166, which may include digital signal processing circuitry where necessary. Communication interface 1166 may in some cases be a cellular modem, Communication interface 1166 may provide for communications under various modes or protocols, such as GSM voice calls, SMS, EMS, or MMS messaging, CDMA, TDMA, PDC, WCDMA, CDMA2000, or GPRS, among others. Such communication may occur, for example, through radio-frequency transceiver 1168. In addition, short-range communication may occur, such as using a Bluetooth, WiFi, or other such transceiver (not shown). In addition, GPS (Global Positioning System) receiver module 1170 may provide additional navigation- and location-related wireless data to device 1150, which may be used as appropriate by applications running on device 1150.

Device 1150 may also communicate audibly using audio codec 1160, which may receive spoken information from a user and convert it to usable digital information. Audio codec 1160 may likewise generate audible sound for a user, such as through a speaker, e.g., in a handset of device 1150. Such sound may include sound from voice telephone calls, may include recorded sound (e.g., voice messages, music files, etc.) and may also include sound generated by applications operating on device 1150.

The computing device 1150 may be implemented in a number of different forms, as shown in FIG. 11. For example, it may be implemented as a cellular telephone 1180. It may also be implemented as part of a smartphone 1182, smart watch, personal digital assistant, or other similar mobile device.

Operating Environment

Implementations of the subject matter and the operations described in this specification can be implemented in digital electronic circuitry, or in computer software, firmware, or hardware, including the structures disclosed in this specification and their structural equivalents, or in combinations of one or more of them. Implementations of the subject matter described in this specification can be implemented as one or more computer programs, i.e., one or more modules of computer program instructions, encoded on computer storage medium for execution by, or to control the operation of, data processing apparatus. Alternatively or in addition, the program instructions can be encoded on an artificially-generated propagated signal, e.g., a machine-generated electrical, optical, or electromagnetic signal, that is generated to encode information for transmission to suitable receiver apparatus for execution by a data processing apparatus. A computer storage medium can be, or be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially-generated propagated signal. The computer storage medium can also be, or be included in, one or more separate physical components or media (e.g., multiple CDs, disks, or other storage devices).

The operations described in this specification can be implemented as operations performed by a data processing apparatus on data stored on one or more computer-readable storage devices or received from other sources.

The term "data processing apparatus" encompasses all kinds of apparatus, devices, and machines for processing data, including by way of example a programmable processor, a computer, a system on a chip, or multiple ones, or combinations, of the foregoing. The apparatus can include special purpose logic circuitry, e.g., an FPGA (field programmable gate array) or an ASIC (application-specific integrated circuit). The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages, and it can be deployed in any form, including as a stand-alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language resource), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform actions by operating on input data and generating output. The processes and logic flows can also be performed by, and apparatus can also be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for performing actions in accordance with instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However; a computer need not have such devices. Moreover, a computer can be embedded in another device, e.g., a mobile telephone, a personal digital assistant (PDA), a mobile audio or video player, a came console, a Global Positioning System (GPS) receiver, or a portable storage device (e.g., a universal serial bus (USB) flash drive), to name just a few. Devices suitable for storing computer program instructions and data include all forms of non-volatile memory, media and memory devices, including by way of example semiconductor memory devices, e.g., EPROM, EEPROM, and flash memory devices, magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, implementations of the subject matter described in this specification can be implemented on a computer having a display device, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending resources to and receiving resources from a device that is used by the user; for example, by sending web pages to a web browser on a user's client device in response to requests received from the web browser.

Implementations of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described in this specification, or any combination of one or more such back-end, middleware, or front-end components. The components of the system can be interconnected by any form or medium of digital data communication, e.g., a communication network. Examples of communication networks include a local area network ("LAN") and a wide area network ("WAN"), an internetwork (e.g., the Internet), and peer-to-peer networks (e.g., ad hoc peer-to-peer networks).

The computing system can include clients and servers. A client and server are generally remote from each other and typically interact through a communication network. The relationship of client and server arises by virtue of computer programs running on the respective computers and having a client-server relationship to each other. In some implementations, a server transmits data (e.g., an HTML page) to a client device (e.g., for purposes of displaying data to and receiving user input from a user interacting with the client device). Data generated at the client device (e.g., a result of the user interaction) can be received from the client device at the server.

A system of one or more computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

Each numerical value presented herein is contemplated to represent a minimum value or a maximum value in a range for a corresponding parameter. Accordingly, when added to the claims, the numerical value provides express support for claiming the range, which may lie above or below the numerical value, in accordance with the teachings herein. Every value between the minimum value and the maximum value within each numerical range presented herein (including in the charts shown in the figures), is contemplated and expressly supported herein, subject to the number of significant digits expressed in each particular range. Absent express inclusion in the claims, each numerical value presented herein is not to be considered limiting in any regard.

Unless expressly described elsewhere in this application, as used herein, when the term "substantially" or "about" is before a quantitative value, the present disclosure also includes the specific quantitative value itself, as well as, in various cases, a ±1%, ±7%, ±5%, and/or ±10% variation from the nominal value unless otherwise indicated or inferred.

Having described herein illustrative embodiments, persons of ordinary skill in the art will appreciate various other features and advantages of the invention apart from those specifically described above. It should therefore be understood that the foregoing is only illustrative of the principles of the invention, and that various modifications and additions, as well as all combinations and permutations of the various elements and components recited herein, can be made by those skilled in the art without departing from the spirit and scope of the invention. Accordingly, the appended claims shall not be limited by the particular features that have been shown and described, but shall be construed also to cover any obvious modifications and equivalents thereof.

What is claimed is:

1. A method of operating a moveable architectural element, the method comprising:

performing a first part of a movement of the moveable architectural element along a portion of a length of actuation using a motor;

performing a second part of the movement of the moveable architectural element with a desired movement profile and, based thereon, measuring an operation parameter;

comparing the measured operation parameter to a profile of the operation parameter;

based on a first differential between the measured operation parameter and the profile of the operation parameter exceeding a differential threshold, incrementing a first counter; and based on the first counter exceeding a counter threshold, adjusting the second part of the movement of the moveable architectural element.

2. The method of claim 1, wherein the profile of the operation parameter comprises an average operation parameter or a median operation parameter.

3. The method of claim 2, wherein comparing the measured operation parameter to the profile of the operation parameter further comprises:

comparing the measured operation parameter to the average operation parameter.

4. The method of claim 3, wherein the average operation parameter is determined based on at least one of: one or more predefined values of the operation parameter and one or more previously measured operation parameters.

5. The method of claim 4, wherein the one or more previously measured operation parameters comprise a subset of one or more measurements of the operation parameter, wherein each of the one or more measurements corresponds to a recent position of a threshold number of most recent positions of the moveable architectural element.

6. The method of claim 4, further comprising:

adding the measured operation parameter to the one or more previously measured operation parameters; and updating the average operation parameter.

7. The method of claim 6, further comprising:

removing, before updating the average operation parameter, an oldest measurement from the one or more previously measured operation parameters.

8. The method of claim 1, wherein the desired movement profile comprises at least one of a speed profile and an acceleration profile.

9. The method of claim 8, wherein the speed profile comprises an approximately constant speed and the acceleration profile comprises approximately zero acceleration.

10. The method of claim 1, wherein the desired movement profile is based on a desired motor parameter profile.

11. The method of claim 10, wherein the desired motor parameter profile comprises at least one of a load profile, a speed profile, a voltage profile, a current profile, and a pulse width modulation profile.

12. The method of claim 1, wherein the operation parameter comprises at least one of a load on the motor, a speed of the motor, a voltage delivered to the motor, a current delivered to the motor, and a pulse width modulation delivered to the motor.

13. The method of claim 12, wherein the operation parameter comprises the load on the motor and wherein the load on the motor is measured as an alignment angle value.

14. The method of claim 1, wherein adjusting the second part of the movement of the moveable architectural element comprises at least one of stopping the second part of the movement, reducing a speed of the second part of the movement, and reversing a direction of the second part of the movement.

15. The method of claim 1, wherein the moveable architectural element comprises a furniture item.

16. The method of claim 15, wherein the operation parameter varies along the length of actuation at least in part because of one or more objects that are positioned in a path of the furniture item along the length of actuation.

17. The method of claim 1, wherein the motor comprises at least one of an electric DC motor and a stepper motor.

18. The method of claim 1, wherein the movement comprises vertical movement along the length of actuation, wherein the length of actuation comprises a wall surface.

19. The method of claim 1, further comprising:

based on the differential between the measured operation parameter and the profile of the operation parameter does not exceed the differential threshold, resetting the first counter.

20. A system for operating a moveable architectural element, the system comprising:

a motor adapted to move the moveable architectural element along a length of actuation;

at least one of a controller and a data processing apparatus, programmed to perform operations comprising:

performing a first part of a movement of the moveable architectural element along a portion of the length of actuation using the motor;

performing a second part of the movement of the moveable architectural element with a desired movement profile and, based thereon, measuring an operation parameter;

comparing the measured operation parameter to a profile of the operation parameter;

based on a first differential between the measured operation parameter and the profile of the operation parameter exceeding a differential threshold, incrementing a first counter; and based on the first counter exceeding a counter threshold, adjusting the second part of the movement of the moveable architectural element; and a memory unit for storing the profile of the operation parameter.

* * * * *